US012398529B2

(12) United States Patent
Faivre

(10) Patent No.: US 12,398,529 B2
(45) Date of Patent: Aug. 26, 2025

(54) LOADER LATCHING ASSIST METHOD AND APPARATUS

(71) Applicant: Deere & Company, Moline, IL (US)

(72) Inventor: Damien Faivre, Apremont (FR)

(73) Assignee: Deere & Company, Moline, IL (US)

( * ) Notice: Subject to any disclaimer, the term of this patent is extended or adjusted under 35 U.S.C. 154(b) by 315 days.

(21) Appl. No.: 17/970,076

(22) Filed: Oct. 20, 2022

(65) Prior Publication Data

US 2024/0133151 A1 Apr. 25, 2024
US 2024/0229413 A9 Jul. 11, 2024

(51) Int. Cl.
*E02F 3/36* (2006.01)

(52) U.S. Cl.
CPC ..... *E02F 3/3695* (2013.01)

(58) Field of Classification Search
CPC ..... E02F 3/3695
See application file for complete search history.

(56) References Cited

U.S. PATENT DOCUMENTS 8,527,158 B2 * 9/2013 Faivre ..... E02F 9/265 701/50
8,998,256 B2 4/2015 Faivre
9,267,263 B2 2/2016 Bertrand et al.
9,567,018 B1 * 2/2017 Pigeon ..... B62D 49/065
9,650,754 B2 5/2017 Martinez et al.
9,714,499 B2 * 7/2017 Faivre ..... E02F 3/431
10,053,838 B2 8/2018 Kean et al.
10,119,242 B1 * 11/2018 Faivre ..... E02F 3/627
D839,109 S 1/2019 Janse
10,358,789 B2 * 7/2019 Hyder ..... E02F 3/6273
(Continued)

FOREIGN PATENT DOCUMENTS

CA 3032558 A1 9/2019
CA 3146456 A1 10/2022
(Continued)

OTHER PUBLICATIONS

Extended European Search Report and Written Opinion issued in European Patent Application No. 23199931.9 dated Mar. 20, 2024, in 07 pages.

*Primary Examiner* — Peter D Nolan
*Assistant Examiner* — Wae L Louie
(74) *Attorney, Agent, or Firm* — Tucker Ellis LLP

(57) ABSTRACT

A method and apparatus assists coupling a loader with a work vehicle. A pre-position instruction signal is generated to pre-position the loader in a predetermined orientation to facilitate the coupling. A forward movement instruction signal is generated for initiating movement of the associated work vehicle 1 towards the loader. A coupled confirmation signal representative of the loader being coupled with the associated work vehicle is received. A forward movement pause instruction signal for pausing the movement of the associated work vehicle towards the loader is generated responsive to receiving the coupled confirmation signal. One or more of the pre-position instruction signal, the forward movement instruction signal, and/or the forward movement pause instruction signal may be automated signals delivered to the work vehicle for executing the commands or images rendered on a human readable display unit for instructing an operator actions to take for coupling the loader with the work vehicle.

20 Claims, 11 Drawing Sheets

(56) References Cited

U.S. PATENT DOCUMENTS

| | | | | |
|---|---|---|---|---|
| 11,047,107 | B2 | 6/2021 | Ballaire | |
| 11,136,744 | B2 | 10/2021 | Myers et al. | |
| 11,174,621 | B2 | 11/2021 | Nygren et al. | |
| 11,248,360 | B2 | 2/2022 | Nygren et al. | |
| 11,952,743 | B2 * | 4/2024 | Kennedy | E02F 3/6273 |
| 2013/0253814 | A1 * | 9/2013 | Wirthlin | B60D 1/62 701/1 |
| 2014/0119872 | A1 | 5/2014 | Faivre | |
| 2015/0093226 | A1 | 4/2015 | Faivre et al. | |
| 2015/0093227 | A1 | 4/2015 | Faivre | |
| 2016/0348334 | A1 | 12/2016 | Martinez et al. | |
| 2018/0179735 | A1 * | 6/2018 | Newlin | F15B 11/08 |
| 2018/0211450 | A1 | 7/2018 | Gresch | |
| 2019/0234044 | A1 | 8/2019 | Nygren et al. | |
| 2019/0234774 | A1 | 8/2019 | Nygren | |
| 2019/0309772 | A1 | 10/2019 | Faivre et al. | |
| 2019/0338809 | A1 | 11/2019 | Clark et al. | |
| 2019/0368156 | A1 * | 12/2019 | Faivre | A01B 59/064 |
| 2019/0378354 | A1 | 12/2019 | Nygren et al. | |
| 2020/0068023 | A1 | 2/2020 | Nygren | |
| 2020/0181874 | A1 * | 6/2020 | Mahrenholz | E02F 3/6427 |
| 2021/0222400 | A1 | 7/2021 | Myers et al. | |
| 2022/0112696 | A1 | 4/2022 | Sud et al. | |
| 2024/0133151 | A1 * | 4/2024 | Faivre | E02F 9/265 |
| 2024/0229413 | A9 * | 7/2024 | Faivre | E02F 3/34 |

FOREIGN PATENT DOCUMENTS

| | | | |
|---|---|---|---|
| EP | 2843378 | A1 | 3/2015 |
| EP | 2857592 | A1 | 4/2015 |

* cited by examiner

LOADER LATCHING ASSIST METHOD AND APPARATUS

FIELD OF THE DISCLOSURE

The present disclosure relates to loaders and work vehicles and, in particular, to methods and apparatus assisting coupling loaders with work vehicles such as tractors.

BACKGROUND

Loader arrangements, i.e., the arrangement of a loader on a work vehicle, in particular on an agricultural vehicle, or on different types of utility vehicles, are known. Loaders can be connected to, or mounted on, a vehicle, for example onto a tractor or an agricultural or other vehicle by means of a mounting frame, in order to carry out loader operations. The mounting frame is customarily bolted or otherwise secured or connected to the vehicle frame or fastened to the latter for selective removal as necessary or desired. The loader itself has a corresponding connecting or mounting point or mounting mast that may be selectively connected to, or mounted on, or coupled to, the mounting frame on the work vehicle.

For efficient work flow, operators prefer to drive the work vehicle to a position adjacent to the loader, then mechanically engage one or more connecting or mounting points of the loader with a corresponding one or more connecting or mounting points of the mounting frame on the work vehicle, all without leaving the operator's station of the work vehicle or, at a minimum, all by leaving the operator's station of the tractor only once such as to couple the vehicle hydraulics with corresponding hydraulic subsystems of the loader. Operators also prefer that they are able to establish the desired mutual mechanical connection between the loader and the mounting frame on the work vehicle on their first attempt. This is commonly referred to as a "1-trip" connection. True 1-trip connections are seldom realized in practice for several reasons including misalignment between the connecting or mounting points of the loader and mounting frame. Geometric alignment between connection points of the vehicle and those of the loader arrangement can sometimes change during a time in which the loader arrangement was decoupled from the vehicle for reasons including location instabilities such as for example ground unevenness, subsidence of the ground, etc.

Typical loaders have two parallel arms that extend at the front end of the tractor and that are equipped with a corresponding loading tool, such as a shovel, a gripper, a loading fork, etc. The arms and the loader tool are usually operable by hydraulic or electrical actuators. Apparatus such as parking stands have been proposed that help to stage or otherwise pre-position such loader arrangements prior to attempting to couple the loader onto the tractor. Parking stand units are available that typically comprise pivotable parking support members that are provided on the underside of the arms of the front loader. The pivotable parking support members can be brought into a lowered parking position, and locked in the parking position wherein, in the parking position, the front loader can be decoupled from the tractor and can thereby be supported on the parking support in such a manner that the arms are held in an upright coupling and decoupling position when the front loader is so parked. In that way, decoupling or coupling the front loader is made possible by releasing (or closing) a front loader lock and subsequent (or previous) maneuvering of the tractor.

While parking stands have been helpful in improving the efficiency of loader connection work flows, they still fall short of providing consistent 1-trip connection operation because of persistent misalignment between the mounting frame on the work vehicle and the connecting or mounting point of the loader.

Another approach for improving loader attachment efficiency is focused on the interface between the loader and the tractor. To this end, arrangements have been proposed for effecting a float condition in loader hydraulic lift cylinders after the hydraulic fluid supply to the loader is decoupled. The mounting frame on the work vehicle can, for example, comprise a ramp along which the loader mounting mast may be guided and displaced for the coupling and decoupling. By means of the floating condition, the mounting mast can be pivoted about a coupling point thereof with respect to the loader arm, i.e., relative to the loader arm, and, for example during the coupling, can be adapted to a positioning angle with respect to the mounting frame or aligned with respect to the latter. An alignment takes place by bearing bolts of the mounting mast sliding over the ramp during the coupling and being guided into the catch hooks, wherein, by means of this interaction, the bearing bolts are brought into the position thereof provided for the coupling. Without the above-mentioned floating position of the hydraulic cylinder, the mounting mast would be in a rigid connection with respect to the loader arm such that the mounting mast cannot carry out any pivoting movements relative to the loader arm making mutual engagement difficult.

While effecting the float condition in hydraulic lift cylinders of loaders have been helpful in improving the efficiency of work flows, they also may still fall short of providing consistent 1-trip connection operation for reasons including because of the persistent misalignment mentioned above between the connecting or mounting points of the mounting frame on the work vehicle and the connecting or mounting points of the loader.

SUMMARY

In accordance with an aspect, a method is provided for assisting coupling a loader with an associated work vehicle. In any of the embodiments herein, portions of the method for assisting coupling the loader with the associated work vehicle may be performed with the loader and the associated work vehicle disposed in a mutually spaced apart arrangement, and other portions may be performed with the loader and the associated work vehicle disposed in a mutual contact arrangement. The loader and the associated work vehicle may be disposed in the mutually spaced apart arrangement when the loader is resting or otherwise supported by parking stands or the like, for example. In the method and with the loader and the associated work vehicle mutually spaced apart, a pre-position instruction signal is generated to pre-position the loader in a predetermined orientation to facilitate the coupling. In the method and also with the loader and the associated work vehicle mutually spaced apart, a forward movement instruction signal is generated for initiating movement of the associated work vehicle towards the loader. Then, with the loader and the associated work vehicle being in mutual contact, a coupled confirmation signal is received, wherein the coupled confirmation signal is representative of a confirmation of the loader being coupled with the associated work vehicle. The loader and the associated work vehicle being in mutual contact may occur, for example, following or subsequent to the movement of the associated work vehicle towards the loader. In the method and also with the loader and the associated work vehicle being in mutual contact, a forward movement pause instruction signal is generated responsive to receiving the coupled confirmation signal, wherein the forward movement pause instruction signal is generated for pausing the movement of the associated work vehicle towards the loader.

In any of the embodiments herein, the generating the pre-position instruction signal includes generating a pre-position instruction image on a screen of a human readable display unit, wherein the pre-position instruction image informs an operator of the associated vehicle how to pre-position the loader in the predetermined orientation to facilitate the coupling. In addition and in any of the embodiments herein, the generating the forward movement instruction signal includes generating a forward movement instruction image on the screen of a human readable display unit, wherein the forward movement instruction image instructs the operator of the associated work vehicle to initiate the movement of the associated work vehicle towards the loader. In addition and in any of the embodiments herein, the receiving the coupled confirmation signal includes receiving a manual coupled confirmation signal from the operator of the associated vehicle via an input device confirming by the operator that the loader is coupled with the associated work vehicle. In addition and in any of the embodiments herein, the generating the forward movement pause instruction signal includes generating, responsive to receiving the coupled confirmation signal, a forward movement pause instruction image on the screen of the human readable display unit, wherein the forward movement pause instruction image instructs the operator of the associated work vehicle to pause the movement of the associated work vehicle towards the loader.

In any of the embodiments herein, the method for assisting coupling a loader with an associated work vehicle further incudes displaying an orientation image on the screen of the human readable display unit, wherein the orientation image is representative of desired orientations of one or more components of the loader informing the operator of the associated vehicle how to move the one or more components of the loader to predetermined positions for pre-positioning the loader in the predetermined orientation to facilitate the coupling.

In any of the embodiments herein, the displaying the orientation image includes displaying an orientation image on the screen of the human readable display unit of one or more of an orientation of a carrier arm of the loader, an orientation of a mast arm of the loader, and/or an orientation of a mounting mast of the loader that is operably coupleable with a corresponding mounting frame affixed to the associated work vehicle.

In any of the embodiments herein, the receiving the coupled confirmation signal includes receiving the coupled confirmation signal as a loader locked signal from a loader locked sensor disposed at an interface between a mounting mast of the loader that is operably coupleable with a corresponding mounting frame affixed to the associated work vehicle, wherein the loader locked signal received from the loader locked sensor is representative of a confirmation of the loader being coupled with the associated work vehicle.

In any of the embodiments herein, the method for assisting coupling a loader with an associated work vehicle further incudes generating a float condition instruction signal with the loader and the associated work vehicle being in mutual contact and with the associated work vehicle moving towards the loader, wherein the generating the float condition instruction signal is to establish a float condition in hydraulic lifting cylinders of the loader to relax a mounting mast of the loader that is operably coupleable with a corresponding mounting frame affixed to the associated work vehicle permitting the mounting mast to move relative to the mounting frame during the coupling.

In any of the embodiments herein, the generating the float condition instruction signal includes generating a float condition cycle instruction image on the screen of the human readable display unit, wherein the float condition cycle instruction image instructs the operator of the associated work vehicle to intermittently establish, with the loader and the associated work vehicle being in mutual contact and with the associated work vehicle moving towards the loader, the float condition between periods of a locked condition of the mounting mast of the loader wherein in the locked condition movement between the mounting mast and the mounting frame is prevented.

In any of the embodiments herein, the generating the float condition instruction signal includes delivering the float condition cycle instruction signal via a communication interface to a controller the associated work vehicle to automatically intermittently establish, with the loader and the associated work vehicle being in mutual contact and with the associated work vehicle moving towards the loader, the float condition between periods of a locked condition of the mounting mast of the loader wherein in the locked condition movement between the mounting mast and the mounting frame is prevented.

In any of the embodiments herein, the generating the pre-position instruction signal includes delivering the pre-position instruction signal via a communication interface to a controller the associated work vehicle to automatically pre-position the loader in the predetermined orientation to facilitate the coupling. In addition and in any of the embodiments herein, the generating the forward movement instruction signal includes delivering the pre-position instruction signal via the communication interface to the controller the associated work vehicle to automatically initiate the movement of the associated work vehicle towards the loader. In addition and in any of the embodiments herein, the receiving the coupled confirmation signal includes automatically receiving the coupled confirmation signal as a loader locked signal from a loader locked sensor disposed at an interface between a mounting mast of the loader that is operably coupleable with a corresponding mounting frame affixed to the associated work vehicle, wherein the loader locked signal received from the loader locked sensor is representative of a confirmation of the loader being coupled with the associated work vehicle. In addition and in any of the embodiments herein, the generating the forward movement pause instruction signal includes delivering, responsive to receiving the coupled confirmation signal, the forward movement pause instruction signal via the communication interface to the controller the associated work vehicle to automatically pause the movement of the associated work vehicle towards the loader.

In accordance with an aspect, an attach assist apparatus is provided for assisting coupling a loader with an associated work vehicle. In an example embodiment, the apparatus includes an attach assist control unit including a processor device, a non-transient memory device operatively coupled with the processor device, and attach assist control logic stored in the memory device. In the example embodiment, the processor device is operable to execute the attach assist control logic to generate a pre-position instruction signal for pre-positioning the loader in a predetermined orientation to facilitate the coupling. The processor device is further operable to execute the attach assist control logic to generate a forward movement instruction signal for initiating movement of the associated work vehicle towards the loader. The processor device is still further operable to execute the attach assist control logic to receive a coupled confirmation signal representative of a confirmation of the loader being coupled with the associated work vehicle. The processor device is yet still further operable to execute the attach assist control logic to generate based on receiving the coupled confirmation signal a forward movement pause instruction signal for pausing the movement of the associated work vehicle 1 towards the loader.

In any of the embodiments herein, the attach assist apparatus further includes a human readable display unit operably coupled with the attach assist control unit, and an input device operably coupled with the attach assist control unit. The human readable display unit includes a screen operable to display images that are viewable by an operator of the associated work vehicle.

The processor device is operable to execute the attach assist control logic to generate the pre-position instruction signal by generating a pre-position instruction image and displaying the pre-position instruction image on the screen of the human readable display unit, wherein the pre-position instruction image informs an operator of the associated vehicle how to pre-position the loader in the predetermined orientation to facilitate the coupling. The processor device is operable to execute the attach assist control logic to generate the forward movement instruction signal by generating a forward movement instruction image, and displaying the forward movement instruction image on the screen of the human readable display unit, wherein the forward movement instruction image instructs the operator of the associated work vehicle to initiate the movement of the associated work vehicle towards the loader. The processor device is operable to execute the attach assist control logic to receive the coupled confirmation signal by receiving a manual coupled confirmation signal by the input device from the operator of the associated vehicle, the coupled confirmation signal confirming by the operator that the loader is coupled with the associated work vehicle. The processor device is operable to execute the attach assist control logic to generate the forward movement pause instruction signal by generating, responsive to receiving the coupled confirmation signal, a forward movement pause instruction image and displaying the forward movement pause instruction image on the screen of the human readable display unit, wherein the forward movement pause instruction image instructs the operator of the associated work vehicle to pause the movement of the associated work vehicle towards the loader.

In any of the embodiments herein, the processor device of the attach assist apparatus is operable to execute the attach assist control logic to display an orientation image on the screen of the human readable display unit, wherein the orientation image is representative of desired orientations of one or more components of the loader informing the operator of the associated vehicle how to move the one or more components of the loader to predetermined positions for pre-positioning the loader in the predetermined orientation to facilitate the coupling.

In any of the embodiments herein, the processor device of the attach assist apparatus is operable to execute the attach assist control logic to display the orientation image on the screen of the human readable display unit as one or more of an orientation of a carrier arm of the loader, an orientation of a mast arm of the loader, and/or an orientation of a mounting mast of the loader that is operably coupleable with a corresponding mounting frame affixed to the associated work vehicle.

In any of the embodiments herein, the attach assist apparatus further includes a sensor input unit operably coupled with the attach assist control unit, and a loader locked sensor operably coupled with the attach assist control unit by the sensor input unit, wherein the loader locked sensor is disposed at an interface between a mounting mast of the loader that is operably coupleable with a corresponding mounting frame 16 affixed to the associated work vehicle. The processor device of the attach assist apparatus is operable to execute the attach assist control logic to receive the coupled confirmation signal by receiving a loader locked signal from the loader locked sensor as the coupled confirmation signal representative of the confirmation of the loader being coupled with the associated work vehicle.

In any of the embodiments herein, the processor device of the attach assist apparatus is operable to execute the attach assist control logic to generate a float condition instruction signal to establish a float condition in hydraulic lifting cylinders of the loader to relax a mounting mast of the loader that is operably coupleable with a corresponding mounting frame affixed to the associated work vehicle permitting the mounting mast to move relative to the mounting frame during the coupling.

In any of the embodiments herein, the processor device of the attach assist apparatus is operable to execute the attach assist control logic to generate the float condition instruction signal by generating a float condition cycle instruction image on the screen of the human readable display unit, wherein the float condition cycle instruction image instructs the operator of the associated work vehicle to intermittently establish, with the loader and the associated work vehicle being in mutual contact and with the associated work vehicle moving towards the loader, the float condition between periods of a locked condition of the mounting mast of the loader wherein in the locked condition movement between the mounting mast and the mounting frame is prevented.

In any of the embodiments herein, the attach assist apparatus further includes a control signal output unit operably coupled with the attach assist control unit, and a valve operably coupled with the attach assist control unit by the control signal output unit, wherein the valve is responsive to a control signal generated by the attach assist apparatus to actuate to selectively relieve hydraulic fluid from a chamber of one or more hydraulic lifting cylinders of the loader. The processor device is operable to execute the attach assist control logic to generate the float condition instruction signal as the control signal to establish a float condition in hydraulic lifting cylinders of the loader to relax a mounting mast of the loader that is operably coupleable with a corresponding mounting frame affixed to the associated work vehicle permitting the mounting mast to move relative to the mounting frame during the coupling.

In any of the embodiments herein, the attach assist apparatus further includes a communication interface operably coupling the attach assist control unit with a controller of the associated work vehicle, and a loader locked sensor operably coupled with the attach assist control unit by the sensor input unit, wherein the loader locked sensor is disposed at an interface between a mounting mast of the loader that is operably coupleable with a corresponding mounting frame affixed to the associated work vehicle. The processor device is operable to execute the attach assist control logic to generate the pre-position instruction signal by delivering the pre-position instruction signal via the communication interface to the controller the associated work vehicle to automatically pre-position the loader in the predetermined orientation to facilitate the coupling.

The processor device is operable to execute the attach assist control logic to generate the forward movement instruction signal by delivering the pre-position instruction signal via the communication interface to the controller of the associated work vehicle to automatically initiate the movement of the associated work vehicle towards the loader.

The processor device is operable to execute the attach assist control logic to receive the coupled confirmation signal by automatically receiving the coupled confirmation signal as a loader locked signal from the loader locked sensor, the loader locked signal from the loader locked sensor being representative of the confirmation of the loader being coupled with the associated work vehicle.

The processor device is operable to execute the attach assist control logic to generate the forward movement pause instruction signal by delivering, responsive to receiving the coupled confirmation signal, the forward movement pause instruction signal via the communication interface to the controller the associated work vehicle to automatically pause the movement of the associated work vehicle towards the loader.

Other embodiments, features and advantages of the example embodiments for assisting coupling loaders with work vehicles such as tractors will become apparent from the following description of the embodiments, taken together with the accompanying drawings, which illustrate, by way of example, the principles of the example embodiments.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to exemplify the embodiments of this invention.

DETAILED DESCRIPTION

In the following description reference is made to the accompanying figures which form a part thereof, and in which is shown, by way of illustration, one or more example embodiments of the disclosed loader latching assist method and apparatus. Various modifications of the example embodiments may be contemplated by on of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" or "one or more of A, B, and/or C" indicates the possibilities of only A, only B, only C, or any combination of two or more of A, B, and C (e.g., A and B; B and C; A and C; or A, B, and C).

Figure 1:
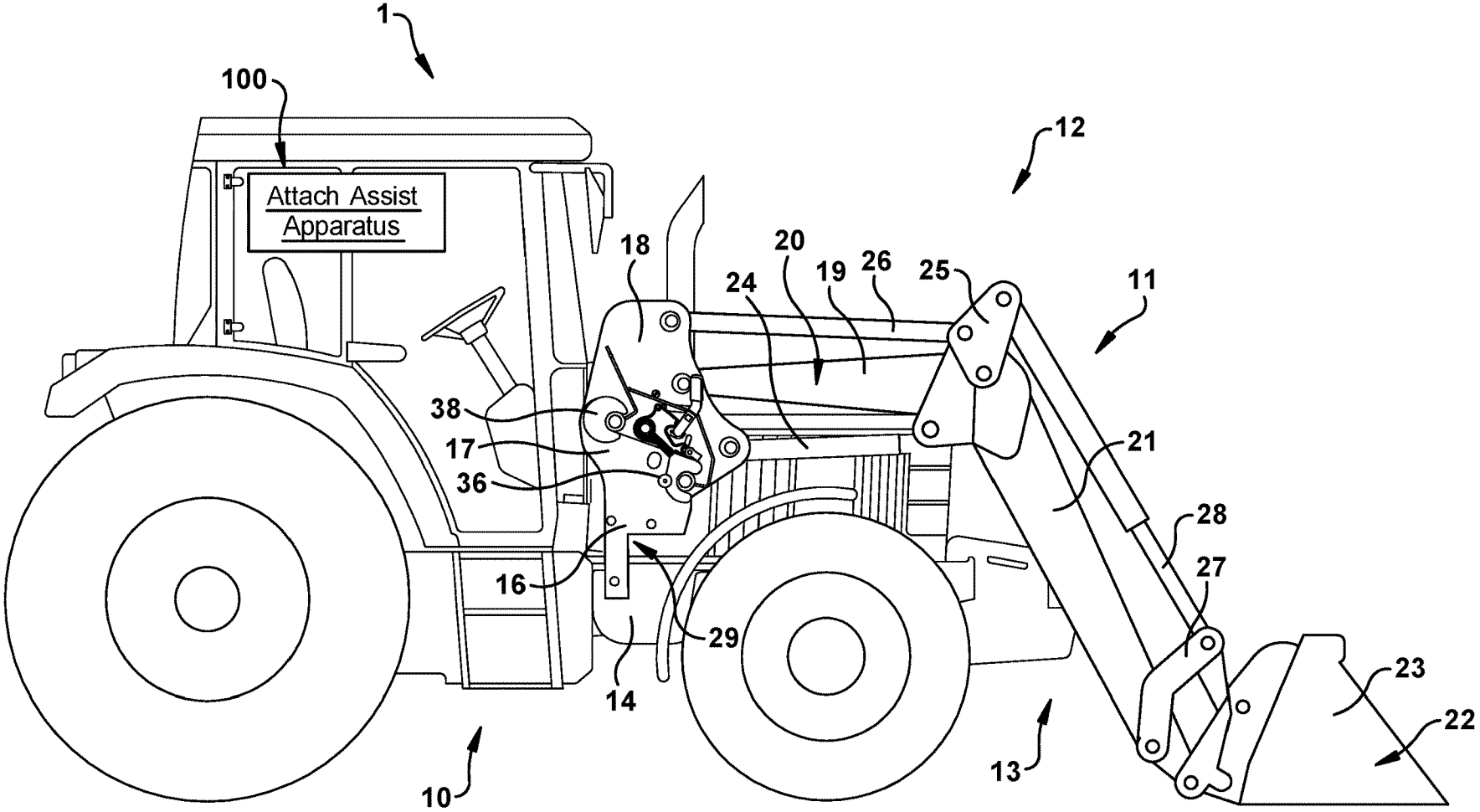
FIG. 1 is a schematic side view of an agricultural vehicle with a front loader arrangement.

Referring now to the drawings, wherein the showings are only for the purpose of illustrating the example embodiments only and not for purposes of limiting the same, FIG. 1 illustrates a work vehicle 1 in the form of an agricultural tractor 10 (carrier vehicle). The tractor 10 has a mounted loader arrangement 11 that may be a front loader arrangement 12 as shown, a wheeled loader arrangement, a telescopic loader arrangement, a rear loader arrangement or any other type loader arrangement. The loader arrangement 11 may have a boom as shown comprising a boom of a front loader or of wheeled loader, or as a jib of a telescopic loader, a rear loader, or the like. Front and rear loaders may be used as attachment units on agricultural tractors or construction machines. The expression "loader" herein is also intended to encompass other loader-like assemblies and machines that have a loader boom or a jib, for example construction machines such as diggers, bulldozers or forestry machines for deforestation of woodland, or if appropriate also cranes.

In the illustrated example, the front loader arrangement 12 comprises a front loader 13, mounting frames 16, and mounting masts 18. The mounting frames 16 are mounted on both sides of a vehicle frame 14 of the tractor 10, for the coupling of the front loader 13 with the tractor 10. The front loader 13 has the mounting masts 18, likewise on both sides of the tractor 10, by means of which the front loader 13 is coupled to the mounting frames 16 via the mounting masts 18, and therefore onto the tractor 10.

The front loader 13 has front loader arms 20 having a rear ends to the left as viewed in the Figure, that are pivotally fastened to the mounting masts 18 and forward ends to the right as viewed in the Figure to which a front loader tool 22 is pivotally connected. The front loader arms 20 extend on opposite sides of the tractor and comprise mast arms 19 and carrier arms 21 that run in parallel on the opposite lateral sides of the tractor 10. The mast arms 19 and carrier arms 21 may be connected to each other via one or more transverse carriers (not shown) as may be necessary or desired for providing a robust and rigid construction. The front loader tool 22 is designed, by way of example, in the form of a loading shovel or bucket 23, wherein the front loader tool 22 could also be designed as any type of work implement including loading forks, grippers, etc. The mast arms 19 of the front loader arms 20 are pivotable via a pair of hydraulic lifting cylinders 24 that respectively extend at opposite lateral sides of the tractor 10 between the respective mounting masts 18 and the respective carrier arms 21 of the front loader arm 20. A tilting linkage 26 serves for the parallel guidance of the front loader tool 22, and extends in each case between links 25 that are pivotally connected to the carrier arms 21 of the front loader arms 20 provided on the opposite lateral sides of the tractor 10, and the respective mounting masts 18. The front loader tool 22 is pivotable on both sides of the front loader arms 20 via a pivoting linkage 27, which is connected to the front loader arms 20 and to the front loader tool 22, and also via a hydraulic pivoting cylinder 28 which is connected to the respective pivoting linkage 27 and to the respective link 25.

The mounting frames 16 of the front loader arrangement 12 each have a receiving region 17 for receiving, or for the coupling of or with, the mounting mast 18. The mounting frames 16 of the front loader arrangement 12 further each have a fastening region 29 for fastening the mounting frames 16 to the vehicle frame 14. At the fastening region 29, the mounting frames 16 are screwed or otherwise bolted or fastened to the vehicle frame 14 via suitable connectors (not shown). The mounting frames 16 each have a first (front) catch hook 36 on a lower front region of the receiving region 17, and a second (rear) catch hook 38 on an upper rear region of the receiving region 17, or hook-shaped bearing points in each case.

The tractor 10 and loader arrangement 11 may be used in combination with an attach assist apparatus 100 according to example embodiments of the present disclosure. The attach assist apparatus 100 of the example embodiments herein may execute or otherwise perform a loader attach assist method providing assistance to an operator for coupling the loader with the tractor and, in particular, for providing assistance to the operator for coupling the mounting mast 18 of the loader 13 onto the mounting frames 16 affixed to the tractor 10, according to examples of the present disclosure.

To provide a useful, albeit non-limiting example, the attach assist apparatus 100 of the example embodiments is described below in conjunction with a particular type of work vehicle 1, shown in the form of an agricultural tractor 10, equipped with a particular type of front loader tool 22 carrying an implement such as the bucket implement 23. However, it is to be appreciated that the attach assist apparatus 100 of the example embodiments may be used in conjunction with any type of work vehicle equipped with any type of loader carrying any type of implement. In addition it is to be further appreciated that the attach assist apparatus 100 may be distributed as an integral part of a work vehicle 1, as an integral part of a loader arrangement 11 or other module that may be removably attached to and detached from a work vehicle 1 on an as-needed basis, or as a discrete assembly or multi-component kit that may be installed on an existing work vehicle via retrofit attachment.

It is to be appreciated that the motion of the hydraulic lifting cylinders 24 and the hydraulic pivoting cylinders 28 may be controlled directly by operator manipulation of various levers, pedals and/or other human interface device(s) operatively coupled with hydraulic control components 69 of the loader arrangement 11. It is further to be appreciated that the motion of the loader arrangement 11 may be indirectly controlled by the operator rendering motion commands to via the attach assist apparatus 100 which in turn may operate the various hydraulic control components 69 of the loader arrangement 11 for moving the cylinders 24, 28 and thereby effecting the desired movement of the loader arrangement 11. The attach assist apparatus 100 may directly control the various hydraulic control components 69 of the loader arrangement 11 for moving the cylinders 24, 28 and thereby effecting the desired movement of the loader arrangement 11. The attach assist apparatus 100 also may indirectly control the various hydraulic control components 69 of the loader arrangement 11 by sending signals and/or commands to an electronic control module (ECM) 135 native to the associated work vehicle 1 via a communication link or the like for moving the cylinders 24, 28 by the ECM 135 executing the signals and/or commands and thereby effecting the desired movement of the loader arrangement 11. It is still further to be appreciated that the motion of the hydraulic lifting cylinders 24 and/or hydraulic pivoting cylinders 28 may be controlled by the attach assist apparatus 100 automatically and/or semi-automatically in response to generalized operator commands such as for example return to position (RTP) commands wherein for example the attach assist apparatus 100 may function in an RTP mode to automatically return the mounting mast 18 of the front loader 13 to a position favorable to facilitate 1-step connection of the mounting mast 18 with the mounting frames 16 on the tractor 10, thereby attaching the loader 13 with the tractor 10. In addition, the mounting mast 18 of the front loader 13 may be returned to one or more pre-stored position(s) in response to operator input with the assistance of the attach assist apparatus 100 providing suitable instructions for helping to assist the operator in facilitating 1-step connection of the mounting mast 18 with the mounting frames 16 on the tractor 10, thereby attaching the loader 13 with the tractor 10.

Figure 2:
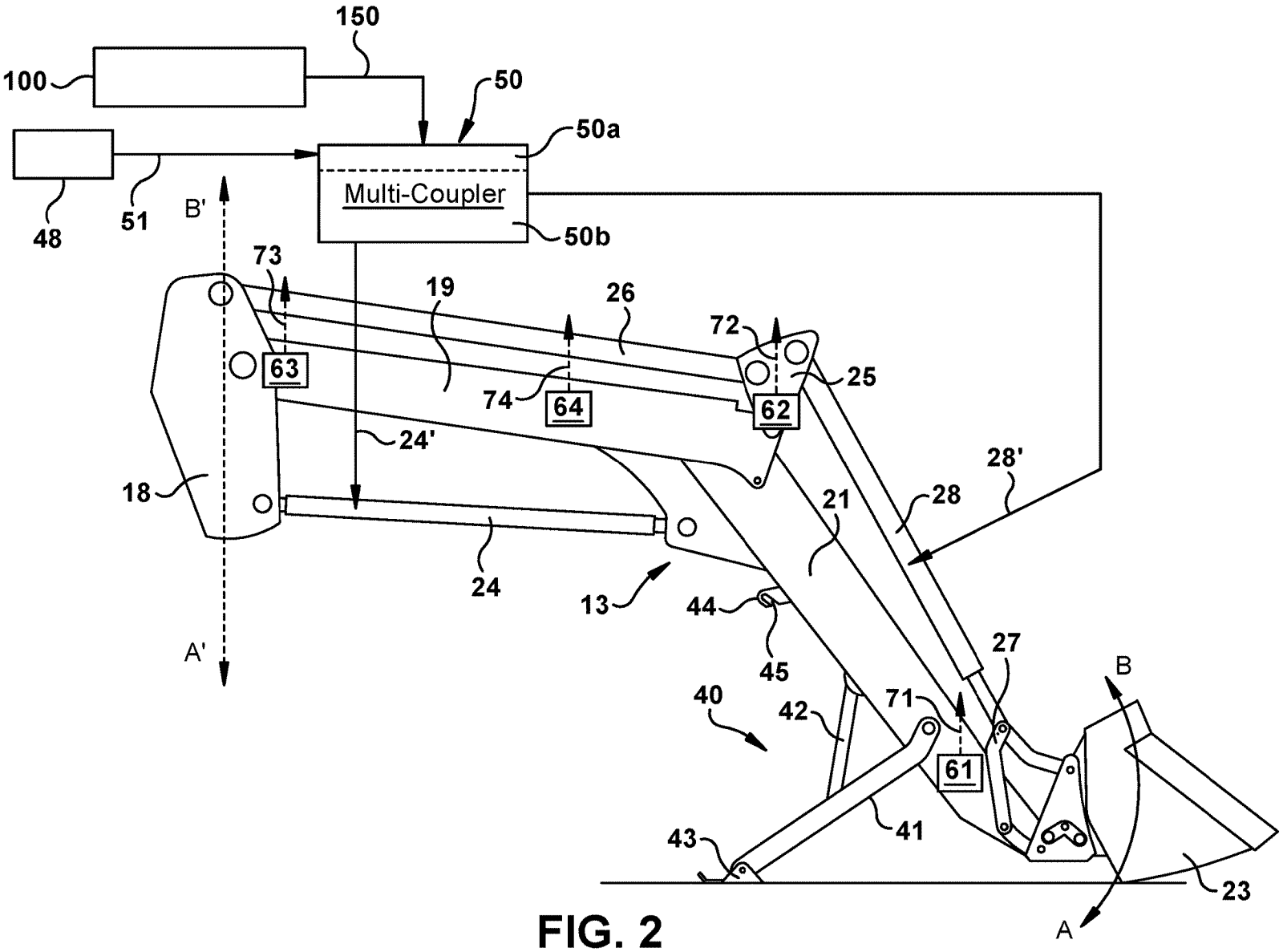
FIG. 2 shows the front loader of FIG. 1 in a perspective schematic side view with its parking stand unit deployed with the front loader separated from the tractor and resting in a freestanding parked position.

The attach assist apparatus 100 is only partially shown in FIG. 1 and an example embodiment of which will be described more fully below in conjunction with FIG. 7. First, however, a general description of the use of parking stands in accordance with example embodiments for improving the efficiency of work flows providing 1-trip connection operation will be described. In this connection, FIG. 2 shows the front loader 13 of FIG. 1 in a perspective side view separated from the tractor, and resting in a freestanding parked position. As shown, the front loader 13 comprises a parking stand unit 40 arranged on the carrier arms 21 of the front loader arms 20.

The parking stand unit 40 of the example embodiment comprises a parking support 41 pivotably articulated on the carrier arms 21 and a locking brace 42, likewise pivotably articulated at one end on the carrier arms 21 and also movably connected at the other end to the parking support 41. The locking brace 42 can be brought into a locking position (as shown in FIG. 2) on the parking support 41, which position it assumes as soon as the parking support 41 has been pivoted into a parking position as illustrated. In the parking position or locking position, the parking support 41 is supported and locked relative to the front loader carrier arms 21 in a position determined by the length and the pivot angle of the locking brace 42.

At the free end of the parking support 41 an oscillating foot 43 is provided, which is mounted by means of a suitable fastener such as a bolt or the like so as to pivot back and forth on the parking support 41. The foot 43 provides a standing or support surface when the parking stand unit 40 is pivoted into the parking or parked position as illustrated in FIG. 2.

Also provided with regard to the parking stand unit 40 of the example embodiment is a catch device 44 that is mounted in the form of a plate furnished with a catch notch 45 on the underside of the front loader carrier arms 21 in such a manner that a latch (not shown) engages in the catch notch 45 in the operating position due to its initial spring tension, thereby holding the parking stand unit 40 in the operating position or locks it in the operating position. By simply actuating the latch inside an elongated hole against an initial spring tension (moving in the longitudinal direction relative to the parking support), the parking stand unit 40 can be unlocked from being held in a stowed away position under the front loader carrier arms 21, and brought into the parking position as illustrated in FIG. 2.

Even though the front loader 13 is detached from the tractor 10 such as shown in FIG. 2, it is selectively animated in accordance with the example embodiments herein for reasons and in ways to be described in greater detail below by supplying hydraulic energy from a source 48 to one or more of the hydraulic lifting cylinders 24 and/or to the hydraulic pivoting cylinders 28. That is, the loader 13 is selectively animated with the loader 13 and the associated work vehicle 1 mutually spaced apart and while resting in the freestanding parked position as shown in FIG. 2. In the example embodiment, a multi-coupler device 50 is responsive to a control signal 150 from the attach assist apparatus 100 to direct a supply hydraulic fluid 51 from the source 48 to the hydraulic lifting cylinders 24 via one or more hydraulic lifting cylinder fluid coupling lines 24' and/or to the hydraulic pivoting cylinders 28 via one or more hydraulic pivoting cylinder fluid coupling lines 28'. The hydraulic lifting and pivoting cylinders 24, 28 may be double acting cylinders but are shown and described using only a single supply line for convenience and ease of illustration and description.

The multi-coupler device 50 comprises first and second mutually coupleable portions 50*a*, 50*b* in the example embodiment, wherein the first and second portions 50*a*, 50*b* are selectively coupled during use of the loader, and selectively separable after the use of the loader so that the work vehicle may be driven away from the loader such as for storage of the loader or for performing other functions with the work vehicle or the like. The first and second portions 50*a*, 50*b* are also selectively couplable prior to use of the loader so that the work vehicle may be driven toward the loader and couple with the loader such as for use of the loader for performing tasks with the work vehicle or the like. For this a dashed line is illustrated for designating that the first and second portions 50*a*, 50*b* may be selectively separated. In the example, one or the other of the first and second portions 50*a*, 50*b* may carry electronics and valves responsive to signals for selective connections to the hydraulic source 48 in response to the control signal 150. It is to be appreciated that the portion of the multi-coupler device 50 carrying the electronics and valves may be in the first portion 50*a* or the second portion 50*b* or in both the first and second portions 50*a*, 50*b* and, further, the portion of the multi-coupler device 50 carrying the electronics and valves may be disposed on the loader 13 or on the tractor 10 as may be necessary or desired. It is further to be appreciated that the first portion 50*a* of the multi-coupler device 50 remains with the associated work vehicle 1 and the second portion 50*b* remains with the loader 13 when the associated work vehicle 1 is driven away from the loader for use elsewhere leaving the second portion 50*b* of the multi-coupler device 50 with the loader 13 supported by the parking stand unit 40 such as shown in FIG. 2.

The motion of the hydraulic lifting cylinders 24 and/or hydraulic pivoting cylinders 28 may be controlled in accordance with an aspect of the example embodiment by the attach assist apparatus 100 automatically and/or semi-automatically operating the multi-coupler device 50 in accordance with an embodiment while the front loader 13 is detached from the tractor 10 and while the first and second portions 50*a*, 50*b* may be selectively coupled. For example the attach assist apparatus 100 may function in an RTP mode to automatically return the mounting mast 18 of the front loader 13 to a position favorable to facilitate 1-step connection of the mounting mast 18 with the mounting frames 16 on the tractor 10, thereby attaching the loader 13 with the tractor 10. In addition, the mounting mast 18 of the front loader 13 may be returned to one or more pre-stored position(s) in response to operator input with the assistance of the attach assist apparatus 100 providing suitable instructions for helping to assist the operator in facilitating 1-step connection of the mounting mast 18 with the mounting frames 16 on the tractor 10, thereby attaching the loader 13 with the tractor 10.

Actuation of the hydraulic pivoting cylinders 28 causing them to extend urges the bucket implement 23 to rotate relative to the carrier arms 21 in the direction A, thereby causing the mounting mast 18 to lower in the general direction A'. In this instance, the front loader essentially pivots counterclockwise about the foot 43. Similarly, actuation of the hydraulic pivoting cylinders 28 causing them to retract urges the bucket implement 23 to rotate relative to the carrier arms 21 in the direction B, thereby causing the mounting mast 18 to raise in the general direction B'. In this instance, the front loader essentially pivots clockwise about the parking stand unit 40.

Actuation of the hydraulic lifting cylinders 24 causing them to extend urges the mast arms 19 to pivot clockwise relative to the carrier arms 21 as viewed in the drawing Figure, thereby causing the mounting mast 18 to raise in the general direction B'. Similarly, actuation of the hydraulic lifting cylinders 24 causing them to retract urges the mast arms 19 to pivot counterclockwise relative to the carrier arms 21 as viewed in the drawing Figure, thereby causing the mounting mast 18 to lower in the general direction A'.

In addition, a set of one or more sensors 60 are disposed at one or more locations on the front loader 13, wherein the one or more sensors 60 generate a corresponding set of one or more signals 70 that are representative of the orientation and/or configuration of the various components of the front loader 13. In accordance with the example embodiments herein, the set of one or more signals 70 that are representative of the orientation and/or configuration of the various components of the front loader 13 and generated by the one or more sensors 60 may be received directly by the attach assist control unit 102 (FIG. 7) of the loader attach assist apparatus 100, and/or they may be received indirectly by the attach assist control unit 102 of the loader attach assist apparatus 100 via the ECM 135 operatively coupled with the attach assist control unit 102 via a network link 130 (FIG. 7) or the like.

For sensing the pivot angle or tilt angle of the front loader tool 22, a tool inclination sensor 61 is provided which is operatively connected directly or indirectly with the pivoting linkage 27. The tool inclination sensor 61 senses the pivot angle between the front loader tool 22 and the carrier arms 21. Since the parking stand unit 40 is rigid and in an opened or deployed position as shown in FIG. 2, the signal 71 generated by the tool inclination sensor 61 is essentially representative of the inclination of the carrier arms 21 relative to the ground supporting the front loader 13.

A link inclination sensor 62 is disposed on the front loader in a position substantially as shown and is operatively coupled directly or indirectly with the link member 25 and/or the mast arms 19. The link inclination sensor 62 senses the pivot angle between the link member 25 and the mast arms 19, and generates a link inclination signal 72 that is representative of the sensed pivot angle between the link member 25 and the mast arms 19.

A mounting mast inclination sensor 63 is disposed on the front loader in a position substantially as shown and is operatively coupled directly or indirectly with the mounting mast members 18 and/or the mast arms 19. The mounting mast inclination sensor 63 senses the pivot angle between the mounting mast members 18 and the mast arms 19, and generates a mounting mast inclination signal 73 that is representative of the sensed pivot angle between the mounting mast members 18 and the mast arms 19.

A mast arm inclination sensor 64 is disposed on the front loader in a position substantially as shown and is operatively coupled directly or indirectly with one or more of the mast arms 19. The mast arm inclination sensor 64 senses the inclination of the mast arms 19, and generates a mast arm inclination signal 74 that is representative of the sensed inclination of the mast arms 19 relative to the ground supporting the front loader 13.

In the example embodiments as described herein, the sensors 61-64 may, for example, be magnetic sensors, potentiometric or optical rotational angle sensors, rotary sensors, rotation sensors, inclination sensors, or any other type of sensors for determining the relative orientations and positions of the various components of the front loader and for generating electrical signals representative of the determined relative positions. In that way, the attach assist apparatus 100 of the example embodiment may determine the positon of the mounting mast 18 for helping to facilitate attachment of the loader 13 onto the tractor in an efficient manner for ease of operation.

According to an aspect of the example embodiment, a front loader arrangement of the type described above is provided with an automated adjusting system and method, by means of which the hydraulic lifting cylinders 24 can be brought into a floating condition when the hydraulic fluid supply is decoupled. Owing to the fact that the hydraulic lifting cylinders 24 are brought into a floating position, the mounting masts 18 can move relatively freely and are not blocked by the hydraulic cylinders, as is otherwise customary during the coupling, since a hydraulic connection between the vehicle and front loader arrangement has been disconnected during the decoupling and, during the coupling, are selectively actuated automatically as may be necessary or desired by the attach assist apparatus 100 in one or more further steps if the mounting masts 18 fail to become coupled onto the mounting frames 16. Each of the mounting frames 16 can, for example, comprise a ramp along which each of the mounting masts 18 may be guided and displaced for the coupling and decoupling. By means of the floating position, the mounting mast can be pivoted about the coupling point thereof with respect to the loader arm, i.e., relative to the loader arm, and, for example during the coupling, can be adapted to a positioning angle with respect to the mounting frame or aligned with respect to the latter. An alignment takes place here by the bearing bolts of the mounting mast sliding over the ramp during the coupling and being guided into the catch hooks, wherein, by means of this interaction, the bearing bolts are brought into the position thereof provided for the coupling. Without the above-mentioned automated control over the floating position of the hydraulic lifting cylinders 24, the mounting mast 18 would be in a rigid connection with respect to the loader arm such that the mounting mast 18 would not be able to carry out any pivoting movements relative to the loader mast arms 19.

Therefore, an initial step in accordance with an example embodiment is to pre-position the level and position or orientation of the mounting mast 18 relative to the ground supporting the front loader 13 prior to moving the tractor 10 towards the loader 13 for connection therewith should the geometrical dimensions between vehicle and front loader arrangement have changed during a time in which the front loader arrangement was decoupled from the vehicle, which is entirely possible, for example due to location instabilities (ground unevenness, subsidence of the ground, etc.), change in the filling of the tires of the vehicle, changes to the tire size, leakages in the hydraulics of the front loader device or because of other circumstances. Then, as a second step in accordance with an example embodiment and in the event that slight misalignment persists after the initial step of pre-positioning the level and position or orientation of the mounting mast 18 relative to the ground making coupling of the front loader arrangement considerably more difficult because of the rigid connection between mounting mast and loader arm, the attach assist apparatus 100 performs an automated control over the floating position of the loader by controlling directly and/or indirectly via the ECM of the tractor hydraulic control components 69 of the loader arrangement 11 including for example control over the hydraulic lifting cylinders 24.

Figure 3:
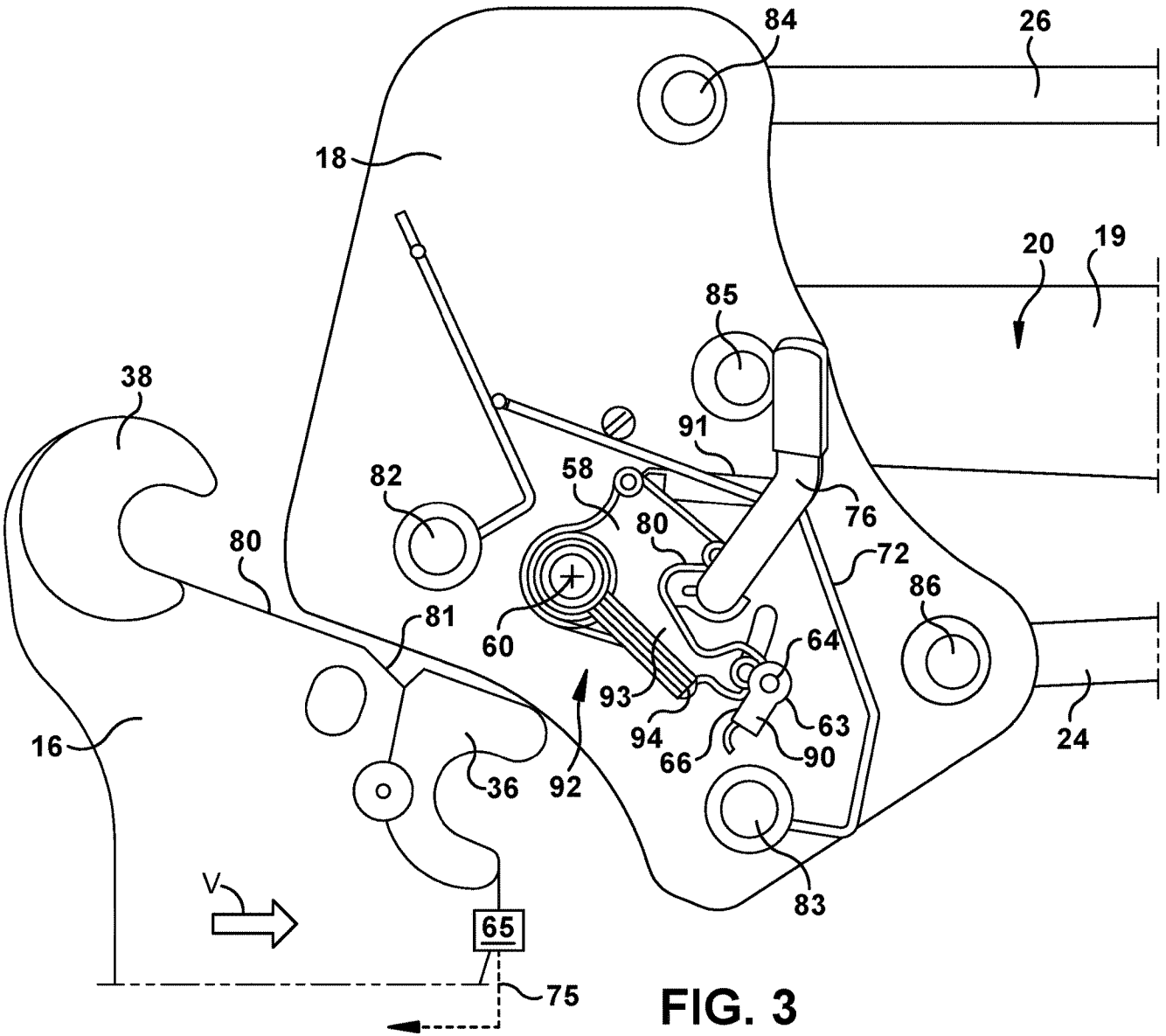
FIG. 3 is a schematic side view of a mounting mast in cross section and of a mounting frame of the front loader arrangement of FIGS. 1 and 2 in a decoupled state.
Figure 4:
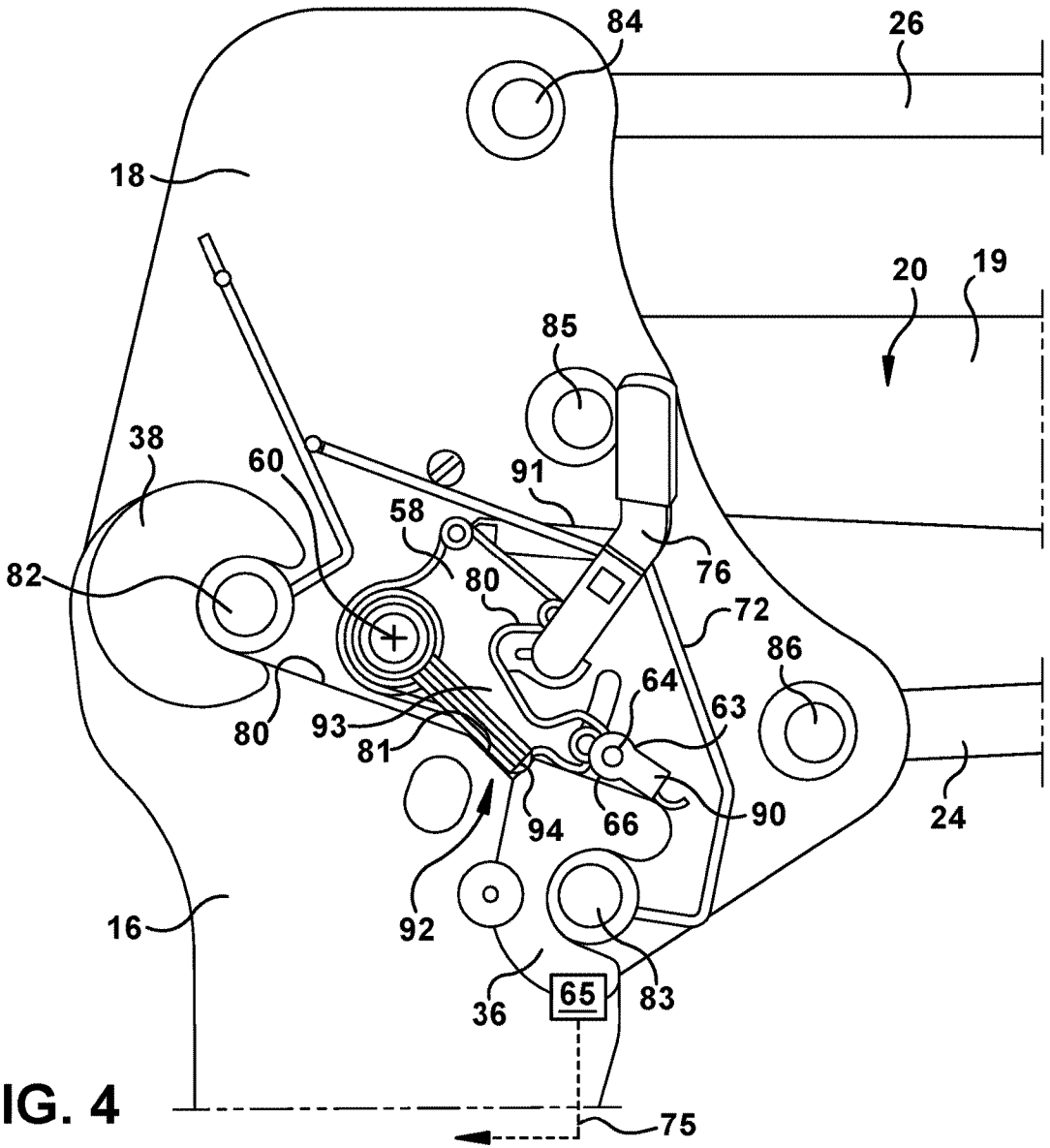
FIG. 4 is a further schematic side view of the mounting mast of the mounting frame of FIGS. 1 to 3 in a coupled state.

FIG. 3 is a schematic side view of a mounting mast in cross section and of a mounting frame of the front loader arrangement of FIGS. 1 and 2 in a decoupled state, and FIG. 4 is a further schematic side view of the mounting mast of the mounting frame of FIGS. 1 to 3 in a coupled state. FIGS. 3 and 4 illustrate a respective combination of the mounting mast 18 and mounting frame 16 at the right side of the front loader arrangement 12 in enlarged form in a plurality of side views and in a plurality of cross-sectional views, in which further individual details of the front loader arrangement 12 are illustrated in detail.

Each of the mountings frame 16 have a ramp 80 or ramp-shaped configuration that extends between the front and rear catch hooks 36 and 38, and, in the lower region of the ramp, a depression or notch 81 is defined directly to the rear of the lower or front catch hook 36.

The mounting mast 18 comprises an upper bearing point and a lower bearing point respectively in the form of an upper bearing bolt 82 and a lower bearing bolt 83. It is conceivable here for the combination of catch hooks 36, 38 and bearing bolts 82, 83 also to be able to be realized in a manner the other way around, such that the bearing bolts 82, 83 are formed on the mounting frame 16 and the catch hooks 36, 38 are formed on the mounting mast 18. Furthermore, an upper pivoting bolt 84, a central pivoting bolt 85 and a lower pivoting bolt 86 are arranged on the mounting mast 18, with the pivoting bolts respectively pivotally connecting the tilting linkage 26, the front loader arm 20 and the hydraulic lifting cylinder 24 to the mounting mast 18.

The front loader 13 or the mounting mast 18 is coupled to the mounting frame 16 as described below with reference to FIGS. 4 and 5. The mounting frame 16 is moved from a decoupled state, in which the front loader 13 is set down and is separated hydraulically and mechanically from the tractor 10, in the direction of the mounting mast 18 corresponding to the movement indicated by the arrow V (FIG. 3). In an example embodiment the movement of the mounting frame 16 in the direction of the mounting mast 18 corresponding to the movement indicated by the arrow V is in response to the attach assist apparatus 100 generating a signal for developing visual command that instruct an operator of the tractor 10 to drive the tractor forward. In another example embodiment the movement of the mounting frame 16 in the direction of the mounting mast 18 corresponding to the movement indicated by the arrow V is in response to the attach assist apparatus 100 generating a signal for delivery to one or more system(s) of the tractor 10 to automatically drive the tractor forward without the need for operator intervention. The upper bearing bolt 82 begins to enter into engagement with the ramp 80 and slides up along the inclined plane of the ramp 80 and along the ramp surface until the bearing bolt enters into engagement with the upper catch hook 38. At this same time, the lower bearing bolt 83 enters into engagement with the lower catch hook 36. Approximately at the time at which the bearing bolts 82, 83 enter into engagement with the catch hooks 38, 36, the lower catch hook 36, or a lower end of the ramp 80, abuts against a supporting means 90 and begins to pivot the latter counter to the pre-tensioning thereof from the position thereof, which is oriented substantially perpendicularly to the ramp surface and in which the supporting means takes up the supporting position, into an increasingly deflected position. When the supporting position of the supporting means 90 is cancelled, a spring 91 on a pivoting locking bar 92 causes the latter to move with a lower pivoting arm 93 thereof in the direction of the ram surface such that, finally, a step 94 of the lower pivoting arm 93 comes to bear against the ramp 80 and slides up along the ramp. As can best be seen in FIG. 4, the mounting mast 18 may reach an end position relative to the mounting frame 16, at which end position the bearing bolts 82, 83 come to bear completely in the catch hooks 38, 36. At the same time, the spring pre-tensioned pivoting locking bar 92 takes up the locking position thereof and latches with the step 94 formed on the first pivoting arm 93 in the depression 81 such that the mounting mast 18 is locked to the mounting frame 16, since relative movement between mounting mast 18 and mounting frame 16 is now blocked firstly by the catch hooks and secondly by the step 94 which has come to bear in the depression 81. The front loader is now in the operating position and can be put into operation.

A loader locked sensor 65 is disposed on or near the interface between the mounting mast 18 and the mounting frame 16 in a position substantially as shown and is operatively coupled directly or indirectly with the attach assist apparatus 100 of the example embodiment. The loader locked sensor 65 senses that the mounting mast 18 is fully and completely locked to or with the mounting frame 16, and generates a loader locked signal 75 that is representative of the sensed mutually locked condition of the mounting mast 18 and the mounting frame 16.

In the example embodiments as described herein, with the loader and the associated work vehicle being in mutual contact, a coupled confirmation signal is received such as for example from the loader locked sensor 65, wherein the coupled confirmation signal is representative of a confirmation of the loader being coupled with the associated work vehicle. The loader and the associated work vehicle being in mutual contact may occur, for example, following or subsequent to the movement of the associated work vehicle towards the loader. In the method and also with the loader and the associated work vehicle being in mutual contact, a forward movement pause instruction signal is generated responsive to receiving the coupled confirmation signal such as for example from the loader locked sensor 65, wherein the forward movement pause instruction signal is generated for pausing the movement of the associated work vehicle towards the loader.

In the example embodiments as described herein, the loader locked sensor 65 may, for example, comprise magnetic sensors, potentiometric or optical rotational angle sensors, rotary sensors, rotation sensors, inclination sensors, or any other type of sensors for determining the that the mounting mast 18 is fully and completely locked to or with the mounting frame 16 and for generating electrical signals representative of the determined locked condition. In that way, the attach assist apparatus 100 of the example embodiment may determine that the mounting mast 18 is fully and completely locked to or with the mounting frame 16 for helping to facilitate attachment of the loader 13 onto the tractor in an efficient manner for ease of operation.

Figure 5:
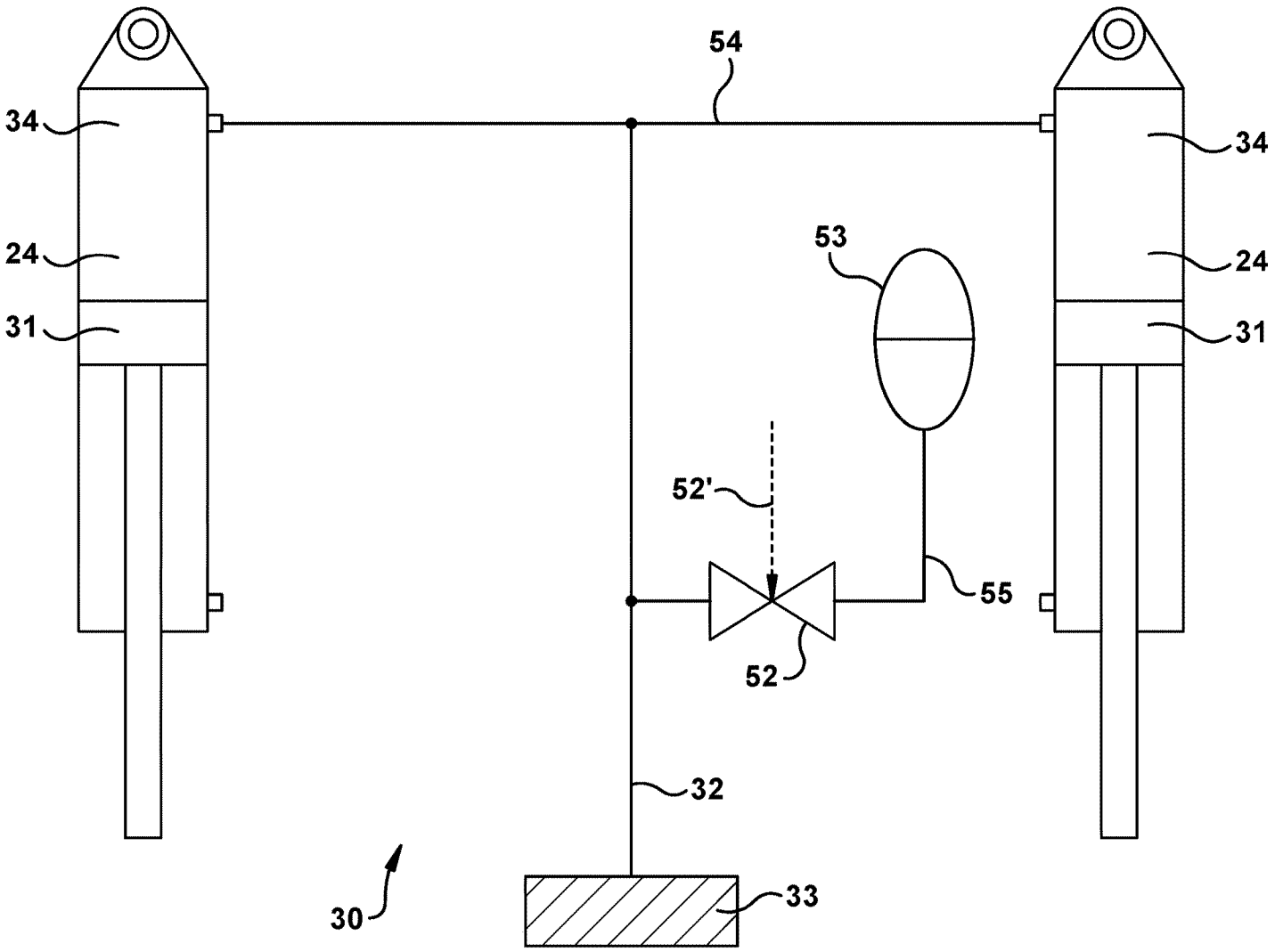
FIG. 5 is a schematic hydraulic circuit diagram for a front loader arrangement with single-acting hydraulic cylinders.

An automated hydraulic adjusting system can be provided in accordance with an example embodiment and as shown for example in FIG. 5 which comprises a hydraulic accumulator and an automatically actuated shut-off valve via which the hydraulic cylinder can be connected fluidly to the hydraulic accumulator. By selectively opening of the shut-off valve under the control of the attach assist apparatus 100 of the example embodiments, the hydraulic accumulator can be fluidly connected to a head end chamber of a hydraulic cylinder acting on one side (the head end chamber constituting the lifting chamber), and therefore hydraulic oil can flow out of the hydraulic cylinder into the hydraulic accumulator and vice versa and the piston in the hydraulic cylinder and the piston rod connected to the piston can move freely. As a result, the mounting mast, as already described above, can also move relatively freely or can be freely pivoted or aligned. The shut-off valve is preferably opened directly after the front loader is decoupled from the vehicle, with a hydraulic oil supply from the vehicle for the hydraulic cylinder of the front loader arrangement (operating hydraulics) customarily also being interrupted or decoupled, as a result of which the hydraulic cylinder is already held in a floating position and is prepared for the next coupling. Of course, the shut-off valve can also be opened just immediately before the next coupling. An automated opening under the control of the attach assist apparatus 100 can be provided here, which may ensure that the floating position for the hydraulic cylinder can be set independently of the vehicle hydraulics or of operating hydraulics for the front loader arrangement. It is entirely also conceivable here to provide an automated mechanical and/or an automated electric device for opening the shut-off valve if the latter can be operated independently of the operating hydraulics of the front loader or ensures the opening of the shut-off valve independently of operating hydraulics, i.e. enables the shut-off valve to open if a connection to the operating hydraulics is interrupted.

Figure 6:
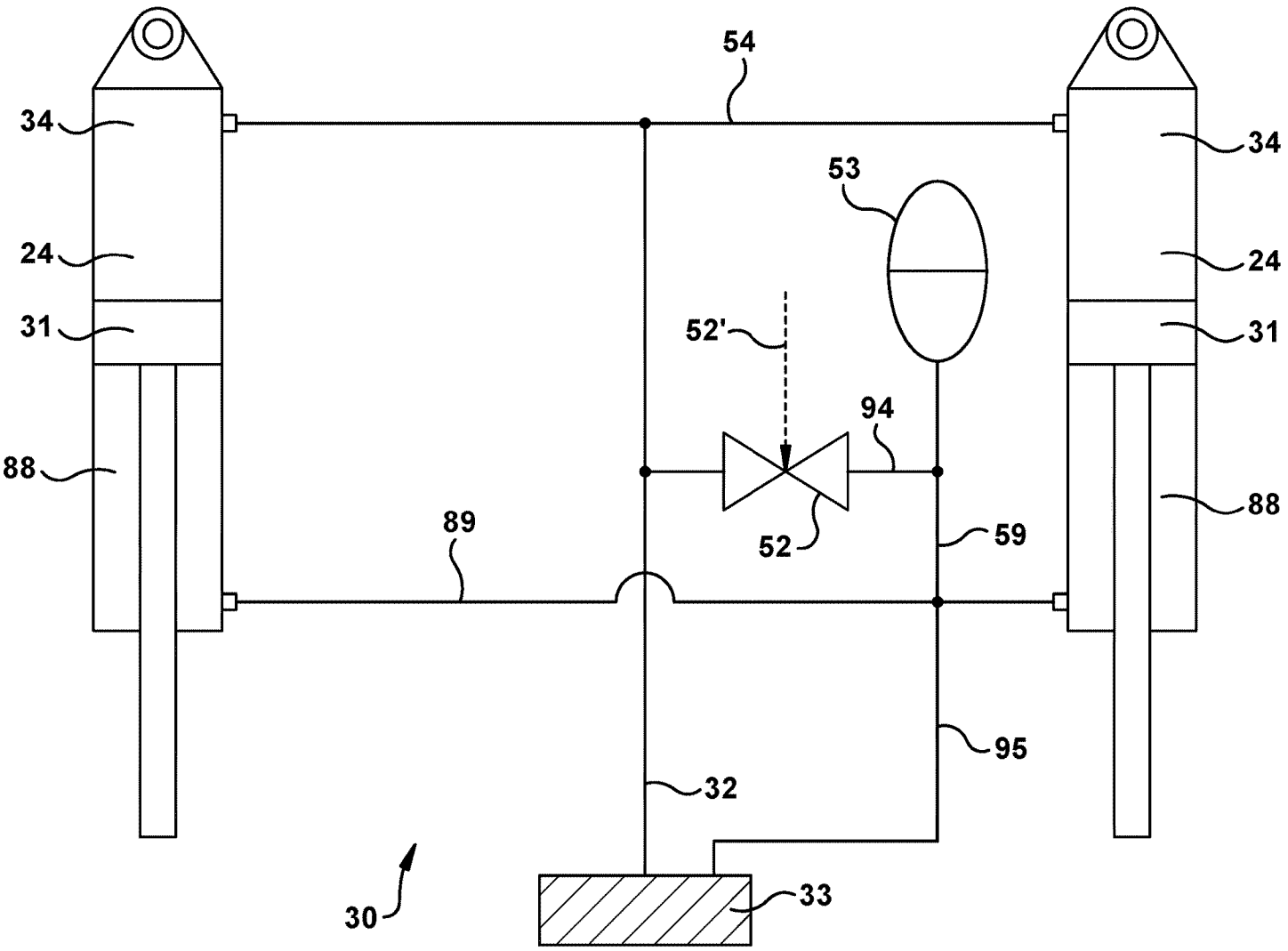
FIG. 6 is a schematic hydraulic diagram for a front loader arrangement with double-acting hydraulic cylinders.

In addition to the above-mentioned design of the hydraulic cylinder, the automated hydraulic adjusting system can also be formed as shown for example in FIG. 6 in a double-acting manner with rod end and head end chambers, wherein the shut-off valve is arranged between the two chambers and between the hydraulic accumulator and the head end chamber. By opening of the shut-off valve, the two chambers are interconnected, with a floating position for the hydraulic cylinder being achieved, and with the volumetric differences or the cross-sectional differences between the two chambers being compensated for by the hydraulic accumulator. As a result, the mounting mast can here also, as described above, move relatively freely or can be freely pivoted or aligned. The shut-off valve is here too preferably opened directly after the decoupling of the front loader from the vehicle, as a result of which the hydraulic cylinder is already held in the floating position and is ready for the next coupling. Of course, the shut-off valve can also be opened just immediately before the next coupling. An automated opening under the control of the attach assist apparatus 100 can be provided here, which may ensure that the floating position for the hydraulic cylinder can be set independently of the vehicle hydraulics or of operating hydraulics for the front loader arrangement. It is entirely also conceivable here to provide an automated mechanical and/or an automated electric device for opening the shut-off valve if the latter can be operated independently of the operating hydraulics of the front loader or ensures the opening of the shut-off valve independently of operating hydraulics, i.e. enables the shut-off valve to open if a connection to the operating hydraulics is interrupted.

In particular and in order to make coupling easier, it is expedient, as has already been described, that, during the coupling, the mounting mast 18 can be adapted as freely as possible to the position of the mounting frame 16 such that the bearing bolts 82, 83 are guided as exactly and precisely as possible into the catch hooks. This is achieved in that the rigid connection between the mounting mast 18 and front loader arms 20, in which, when the hydraulic supply is disconnected, the lifting cylinders 24 remain in the position thereof which they have thus taken up and hold the mounting mast 18 rigidly with respect to the loader arm 20, is cancelled. The mounting mast 18 is thereby brought into a movable state in which the mounting mast can be pivoted relative to the loader arm 20. For this purpose, as FIGS. 5 and 6 schematically show, a shut-off valve 52 and a hydraulic accumulator 53 are provided, wherein FIG. 5 illustrates a hydraulic circuit for a single-acting lifting cylinder and FIG. 6 illustrates a double-acting lifting cylinder. In both cases, the shut-off valve 52 is designed to be automatically selectively actuated by the attach assist apparatus 100 of the example embodiments during the coupling and/or during the decoupling of the front loader 13, when the hydraulic supply is connected or disconnected. In the example embodiments and in both cases of the single-acting and double-acting hydraulic adjusting systems, the shut-off valve 52 is responsive to a control signal 52' generated by the attach assist apparatus 100 to automatically selectively open in response to receiving the control signal 52'. In accordance with the example embodiments herein, the control signal 52' may be generated directly by the attach assist control unit 102 (FIG. 7) of the loader attach assist apparatus 100, and/or the control signal 52' may be generated indirectly by the attach assist control unit 102 via the ECM 135 operatively coupled with the attach assist control unit 102 via a network link 130 or the like.

With regard to FIG. 5, part of a hydraulic system 30 for the supply of two lifting cylinders 24 each acting on one side of the tractor is depicted, the lifting cylinders having a piston 31 and being hydraulically supplied via a hydraulic supply line 32, wherein the supply line 32 extends from a coupling part 33 of a hydraulic quick coupler (not shown) to head end chambers 34 of the lifting cylinders 24. As can be seen in FIG. 1, the head end of the lifting cylinder 24 on the right side of the tractor 10 is connected to the loader arm 20 and on the rod end is connected to the mounting mast 18, with it being understood that the lifting cylinder 24 on the left side of the tractor is similarly connected, and therefore the loader arm 20 can be raised by hydraulic filling of the head end chambers 34. The loader arm 20 is lowered here because of gravitational force, wherein a control valve (not shown) of the hydraulic system 30 is correspondingly actuated in order to raise and lower the front loader, and the hydraulic oil can be pressed out of the head end chambers 34 by the dead weight of the front loader. The two lifting cylinders 24 are furthermore connected to each other by a connecting line 54 and are connected to the supply line 32, and therefore the two lifting cylinders are pressurized uniformly. The shut-off valve 52 is arranged in a further connecting line 55 which connects the supply line 32 to the hydraulic accumulator 53. By opening of the shut-off valve 52, it is ensured that, when the hydraulic supply is disconnected, the hydraulic fluid is not trapped in the head end chambers 34, but rather can escape into the hydraulic accumulator 53, and vice versa. As a result, the lifting cylinders 24 can take up a floating movement of the mounting mast 18 in relation to the loader arm 20, and therefore, when the shut-off valve 52 is open, the mounting mast 18 can be aligned in a freely pivotable manner during the coupling. The opening of the shut-off valve 52 already ideally takes place during the decoupling of the front loader 13 and can thus be carried out by an operator in one working sequence together with an unlocking of the pivoting locking bar 92 described above and the separating of the hydraulic supply (separating of the quick coupler 50). Owing to the fact that the opening of the shut-off valve 52 already takes place during decoupling of the front loader 13, the latter is already prepared for the next coupling operation, and therefore an operator can couple the front loader 13 to the freely movable mounting mast 18 without leaving the tractor 10. After the coupling of the front loader 13, the shut-off valve 52 can be closed for the starting up of the hydraulic function (connecting of the hydraulic supply) in order to ensure a hydraulic operation of the front loader 13. This can likewise take place in one working sequence together with the connection of the quick coupler 50.

By operating the shut-off valve 52 to selectively open and close in response to the control signal 52' generated by the attach assist apparatus of the example embodiments while the tractor is being moved forward, it is ensured that, when the hydraulic supply is alternately disconnected and connected, the hydraulic fluid is not constantly trapped in the head end chambers 34, but rather can alternately escape into the hydraulic accumulator 53, and vice versa. As a result, the lifting cylinders 24 can take up alternating floating and locked movements of the mounting mast 18 in relation to the loader arm 20 and, therefore, when the shut-off valve 52 is open the mounting mast 18 can be aligned in a freely pivotable manner during the coupling, and when the shut-off valve 52 is closed the mounting mast 18 can become locked in place relative to the other components of the front loader and also relative to components of the mounting frame including the catch hooks 36, 38 to establish a resetting or re-initialization of the alignment procedure. The alternate opening and closing of the shut-off valve 52 as controlled by the attach assist apparatus 100 of the example embodiments 100 ideally takes place during the coupling of the front loader 13 when the loader locked sensor 65 does not sense that the mounting mast 18 is fully and completely locked to or with the mounting frame 16, and when the loader locked signal 75 representative of the sensed mutually locked condition of the mounting mast 18 and the mounting frame 16 is not received by the attach assist apparatus 100 within a predetermined time during the coupling of the front loader 13. In this way, the coupling of the front loader 13 can be carried out in one working sequence ("1-trip") by the automated assistance of the attach assist apparatus 100. In the above it is to be appreciated that in accordance with the example embodiments herein, the control signal 52' may be generated directly by the attach assist control unit 102 (FIG. 7) of the loader attach assist apparatus 100 to perform the alternate opening and closing of the shut-off valve 52, and/or the control signal 52' may be generated indirectly by the attach assist control unit 102 via the ECM 135 operatively coupled with the attach assist control unit 102 via a network link 130 or the like to perform the alternate opening and closing of the shut-off valve 52.

With regard to FIG. 6, a part of a hydraulic system 30 for the hydraulic supply of two double-acting lifting cylinders 24 is depicted, the lifting cylinders having a piston 31 and by hydraulically supplied via a hydraulic supply line 32 and a hydraulic supply line 87. The supply line 32 extends from a coupling part 33 of a hydraulic quick coupler (not shown) to head end chambers 34 of the lifting cylinders 24, wherein a connecting line 89 extends from the coupling part 33 to rod end chambers 88. As with the single-acting lifting cylinders 24 described above, the double-acting lifting cylinders 24 at the opposite sides of the tractor 10 have their head ends connected to the loader arm 20 and their rod ends respectively coupled to the masts 18 at the opposite sides of the tractor such that the loader arm 20 is raised and lowered by hydraulic filling of the head end chambers 34, wherein a corresponding activation of a control valve (not shown) of the hydraulic system 30 takes place in a known manner for lifting and lowering the front loader. The head end chambers 34 of the two lifting cylinders 24 are connected to each other by a connecting line 54 that is connected to the supply line 32. Furthermore, the rod end chambers 88 of the lifting cylinders 24 are connected to each other by a connecting line 89 that is connected to the supply line 87. As a result, the two hydraulic cylinders 24 are pressurized uniformly. The hydraulic accumulator 53 is connected to the supply line 87 via a connecting line 59 and therefore also to the connecting line 89 and to the rod end chambers 88. The shut-off valve 52 is arranged in a line 58 coupled between the supply line 32 and the connecting line 59.

By automatically selectively opening the shut-off valve 52 by the attach assist apparatus 100 of the example embodiments, it is ensured that, when the hydraulic supply is disconnected, the hydraulic fluid is not trapped in the chambers 34, 88, but rather can escape into the hydraulic accumulator 53 and into the respective other chamber 34, 88, and vice versa. As a result, the lifting cylinders 24 can take up a floating position in which the pistons 31 are freely movable, wherein volume differences between the head end chambers 34 and the rod end chambers 88 are compensated for by the hydraulic accumulator 53. This state, in turn, permits a relatively free movement of the mounting masts 18 in relation to the loader arm 20, and therefore, when the shut-off valve 52 is open, the mounting masts 18 can be aligned in a freely pivotable manner during the coupling. The opening of the shut-off valve 52 during decoupling of the front loader 13 can take place here in one working sequence together with unlocking of the pivoting locking bar 92 and the separating of the hydraulic supply (separating the quick coupler) by an operator. Owing to the fact that the shut-off valve 52 is already opened during the decoupling of the front loader 13, the latter is also already prepared for the next coupling operation, and therefore an operator can couple the front loader 13 to the freely movable mounting masts 18 without leaving the tractor 10. The shut-off valve 52 also has to be closed here, after the coupling of the front loader 13, for starting up of the hydraulic function (connecting of the hydraulic supply), in order to ensure a hydraulic operation of the front loader 13. However, this can likewise take place in one working sequence together with the connection of the quick coupler.

By operating the shut-off valve 52 to selectively open and close in response to the control signal 52' generated by the attach assist apparatus of the example embodiments while the tractor is being moved forward, it is ensured that, when the hydraulic supply is alternately disconnected and connected, the hydraulic fluid is not constantly trapped in the head end chambers 34, but rather can alternately escape into the hydraulic accumulator 53, and vice versa. As a result, the lifting cylinders 24 can take up alternating floating and locked movements of the mounting mast 18 in relation to the loader arm 20 and, therefore, when the shut-off valve 52 is open the mounting mast 18 can be aligned in a freely pivotable manner during the coupling, and when the shut-off valve 52 is closed the mounting mast 18 can become locked in place relative to the other components of the front loader and also relative to components of the mounting frame including the catch hooks 36, 38 to establish a resetting or re-initialization of the alignment procedure. The alternate opening and closing of the shut-off valve 52 as controlled by the attach assist apparatus 100 of the example embodiments 100 ideally takes place during the coupling of the front loader 13 when the loader locked sensor 65 does not sense that the mounting mast 18 is fully and completely locked to or with the mounting frame 16, and when the loader locked signal 75 representative of the sensed mutually locked condition of the mounting mast 18 and the mounting frame 16 is not received by the attach assist apparatus 100 within a predetermined time during the coupling of the front loader 13. In this way, the coupling of the front loader 13 can be carried out in one working sequence ("1-trip") by the automated assistance of the attach assist apparatus 100.

Figure 7:
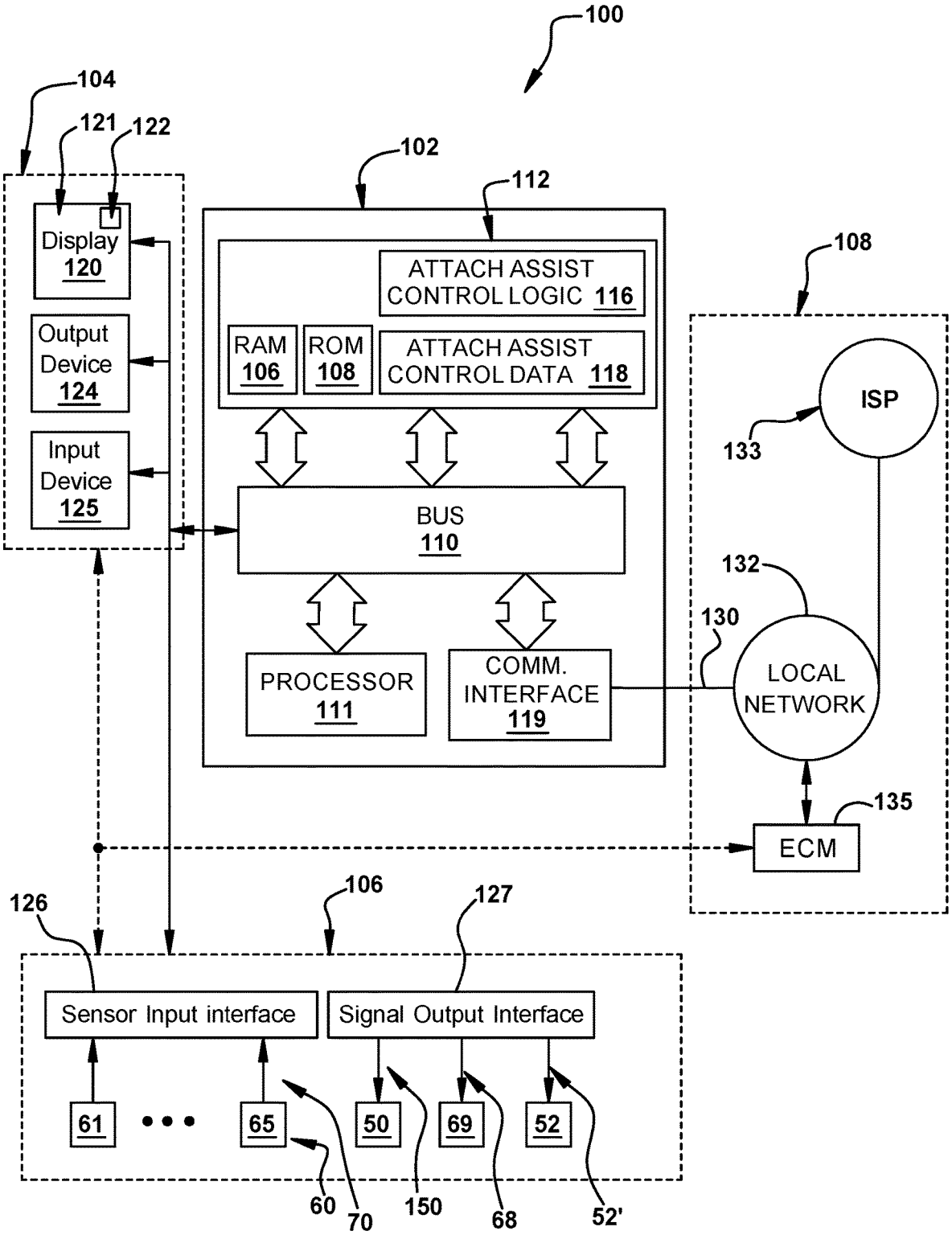
FIG. 7 is a block diagram that illustrates a representative attach assist apparatus according to the example embodiments.

FIG. 7 is a block diagram that illustrates a representative attach assist apparatus 100 according to the example embodiments. The attach assist apparatus 100 is suitable for executing embodiments of one or more software systems or logic modules that perform methods for assisting an operator of an associated work vehicle to couple a loader onto the work vehicle.

The representative example attach assist apparatus 100 includes an attach assist control unit 102, a set of operator interface devices 104, a set of loader interface devices 106, and a set of tractor interface devices 108. The attach assist control unit 102 of the attach assist apparatus 100 according to the illustrated embodiment includes a bus 110 or other communication mechanism for communicating information, a processor device 111 coupled with the bus 110 for processing information, and a non-transient memory device 112 configured to store data, information and/or instructions that are executable by the processor device 111.

The attach assist control unit 102 further includes a non-transient memory device 112 that may be of any memory type and also may include different memory types or portions including for example a random access memory (RAM) 113 or other dynamic storage device for storing information and/or instructions to be executed by the processor device 111, and read only memory (ROM) 114 or other static storage device for storing static information and/or instructions for the processor device 111.

In accordance with the descriptions herein, the terms "computer-readable medium" and "memory device" as used herein refer to any non-transitory media that participates in providing logic instructions and/or data to the processor device 111 for execution and/or processing. Such a non-transitory medium may take many forms, including but not limited to volatile and non-volatile media. Non-volatile media includes, for example, optical or magnetic disks. Volatile media includes dynamic memory for example and does not include transitory signals, carrier waves, or the like. Common forms of computer-readable media include, for example, a floppy disk, a flexible disk, hard disk, magnetic tape, or any other magnetic medium, a CD-ROM, any other optical medium, punch cards, papertape, any other physical medium with patterns of holes, a RAM, PROM, and EPROM, a FLASH-EPROM, any other memory chip or cartridge, or any other tangible non-transitory medium from which a computer can read.

In addition and further in accordance with the descriptions herein, the term "logic", as used herein with respect to the Figures, includes hardware, firmware, software in execution on a machine, and/or combinations of each to perform a function(s) or an action(s), and/or to cause a function or action from another logic, method, and/or system. Logic may include a software controlled microprocessor, a discrete logic (e.g., ASIC), an analog circuit, a digital circuit, a programmed logic device, a memory device containing instructions, and so on. Logic may include one or more gates, combinations of gates, or other circuit components.

With continued reference to FIG. 7, the non-transient memory device 112 may suitably store attach assist control logic 116 comprising instructions for execution by the processor device 111 for controlling one or more portions of the loader 13 and/or one or more portions of the tractor 13 for assisting an operator latch a loader onto the tractor. The non-transient memory device 112 may further suitably store attach assist data 118 comprising information such stored sensor level data relating to desired loader positions for RTP operation by way of example. In this regard, the attach assist apparatus 100 may function in the RTP mode to automatically return the mounting mast 18 of the front loader 13 to a position favorable to facilitate 1-step connection of the mounting mast 18 with the mounting frames 16 on the tractor 10, thereby attaching the loader 13 with the tractor 10. The mounting mast 18 of the front loader 13 may be returned to one or more positions stored as attach assist data 118 in the non-transient memory device 112 for helping to assist the operator in facilitating 1-step connection of the mounting mast 18 with the mounting frames 16 on the tractor 10, thereby attaching the loader 13 with the tractor 10. The attach assist data 118 may further comprise data relating to images or the like for display to a human operator providing instructions or the like for assisting in efficiently attaching the loader onto the tractor.

In addition to the above, the attach assist control unit 102 of the example embodiment further includes a communication interface 119 coupled with the bus 110. The communication interface 119 provides in the example embodiment a two-way data communication coupling between the attach assist control unit 102 of the attach assist apparatus 100 and a network link 130 to be described below in connection with the set of tractor interface devices 108. The communication interface 119 provides a connection between the attach assist control unit 102 and a local network 132 such as for example a local network of the work vehicle 10 such as a Controller Area Network (CAN) bus or the like. The attach assist apparatus 100 may use the communication interface 119 and the network link 130 to indirectly control the various hydraulic control components 69 of the loader arrangement 11 by sending and/or receiving signals and/or commands between the attach assist control unit 102 of the loader attach assist apparatus 100 and the ECM 135 native to the associated work vehicle 1 via a communication link or the like for moving the cylinders 24, 28 by the ECM 135 executing the signals and/or commands and thereby effecting the desired movement of the loader arrangement 11. The communication interface 119 may be a CAN card to provide a data communication connection to a compatible CAN bus. As another example, communication interface 119 may be a local area network (LAN) card to provide a data communication connection to a compatible LAN. For example, communication interface 119 may be an integrated services digital network (ISDN) card or a modem to provide a data communication connection to a corresponding type of telephone line. Wireless links may also be implemented. In any such implementation, communication interface 119 may be a wireless receiver/transmitter, i.e. a transceiver operable to send and receive electrical, electromagnetic, radio frequency (RF), and/or optical signals that carry data streams such as digital data streams representing various types of information.

The set of operator interface devices 104 of the attach assist control unit 102 of the example attach assist apparatus 100 may include several subsystems or modules to perform various interactions with the human operator as set forth herein. A benefit of the subject application is to provide improved guidance by displaying guidance and other instructions on a screen 121 of a display unit 120 that is viewable from an operator's seat of the associated work vehicle for helping the operator to view current positions of the loader and tool mechanisms as well as to visualize preferred or recommended instructions from the attach assist control unit 102 for movement of the loader and tool mechanisms and optionally of the tractor to safely and efficiently couple the loader with the tractor. An output device 124 may also be provided such as in the form of a sound generating device such as a speaker to help improve guidance assistance by generating audible guidance instructions in the form of audible instructions and/or suitable instructional noises such as beeps, voice messages or the like that can be heard from an operator's seat of the associated work vehicle for helping the operator to be alerted to current positions of the mechanisms as well as to be audibly instructed of preferred or recommended paths for movement of the loader and tool mechanisms or of the tractor to safely and efficiently attach the loader 13 onto the tractor 10.

The example embodiment of the attach assist apparatus 100 further includes an input device 125 operatively coupled with the attach assist control unit 102. The input device 125 may be used during a use of the attach assist apparatus 100 for providing assistance in coupling a loader with an associated work vehicle. The input device 125 may also be used during a training of the attach assist apparatus 100 for selection of received one or more loader position training signals such as for example signals 71-74 received from the set 60 of sensors 61-64 representative of desired positions of the mast and carrier arms 19, 21 for alignment and orientation and positioning of the loader 13 in a pre-attachment positon. In an example embodiment the input device 125 may include a touchscreen portion 122 of the display unit 120, a pointer device operatively coupled with the attach assist control unit 102, or any other device or means of communicating training and other information to the attach assist control unit 102 of the attach assist apparatus 100 such as for example for receiving training signals and/or other information signals by the attach assist control unit 102 of the attach assist apparatus 100.

The set of loader interface devices 106 of the attach assist control unit 102 of the example attach assist apparatus 100 may include several subsystems or modules to perform various interactions with the loader 13 as set forth herein. By way of example, a sensor input unit 126 of the set of loader interface devices 106 is configured to receive into the attach assist control unit 102 of the example attach assist apparatus 100 signals 70 generated by the set of one or more sensors 60 are disposed at one or more locations on the front loader 13. In addition, a control signal output unit 127 of the set of loader interface devices 106 is configured to deliver from the attach assist control unit 102 of the example attach assist apparatus 100 loader control signals 68 generated by the attach assist apparatus 100, wherein the loader control signals 68 are configured to operate the various hydraulic control components 69 of the loader arrangement 11 for moving the various hydraulic cylinders and the like thereby effecting the desired movement of the loader arrangement 11.

By way of example, a sensor input unit 126 of the set of loader interface devices 106 is configured to receive into the attach assist control unit 102 of the example attach assist apparatus 100 the signal 71 generated by the tool inclination sensor 61 that is representative of the inclination of the carrier arms 21 relative to the ground supporting the front loader 13. The sensor input unit 126 is also configured to receive the link inclination signal 72 into the attach assist control unit 102 of the example attach assist apparatus 100 from the link inclination sensor 62, wherein the link inclination signal 72 is representative of the sensed pivot angle between the link member 25 and the mast arms 19. The sensor input unit 126 is further configured to receive the mounting mast inclination signal 73 into the attach assist control unit 102 of the example attach assist apparatus 100 from the mounting mast inclination sensor 63, wherein the mounting mast inclination signal 73 is representative of the sensed pivot angle between the mounting mast members 18 and the mast arms 19. The sensor input unit 126 is still further configured to receive the mast arm inclination signal 74 into the attach assist control unit 102 of the example attach assist apparatus 100 from the mast arm inclination sensor 64, wherein the mast arm inclination signal 74 is representative of the sensed inclination of the mast arms 19 relative to the ground supporting the front loader 13. The sensor input unit 126 is yet still further configured to receive the loader locked signal 75 into the attach assist control unit 102 of the example attach assist apparatus 100 from the loader locked sensor 65, wherein the loader locked signal 75 is representative of the sensed mutually locked condition of the mounting mast 18 and the mounting frame 16.

The set of tractor interface devices 108 of the attach assist control unit 102 of the example attach assist apparatus 100 may include several subsystems or modules to perform various communication and/or command interactions between the tractor 10 and the attach assist apparatus 100 as set forth herein. By way of example, the tractor interface devices 108 includes a network link 130 that typically provides data communication through one or more networks to other data devices. For example, network link 130 may provide a connection through a local network 132 to a diagnostic host computer (not shown) of the like for supporting configuration of the system as desired or necessary. An Internet Service Provider (ISP) 133 may provide data communication services indirectly through the Internet via the network 132 or directly through the network link 130.

The example attach assist apparatus 100 can send messages and receive data, including program code, through the network(s), network link 130 and communication interface 119. In the Internet-connected example embodiment, the attach assist apparatus 100 is operatively connected with a plurality of external public, private, governmental or commercial servers (not shown) configured to execute a web application in accordance with example embodiments.

In an example embodiment during system training, the operator may first position the mast arms 19 and/or the carrier arms 21 of the front loader 13 to a desired position relative to the vehicle and/or relative to the ground, then click or drag and drop a virtual indicia on the touchscreen 122 using a pointer or finger onto a selected portion of the image of boom on the screen 121 while the boom is in the desired position, wherein the virtual indicia comprises the boom position training signal representative of a selectable target location for alignment of the mounting mast 18 relative to the mounting frame 16 to establish a desired relative physical position between the mounting mast 18 portion of the loader 13 and the mounting frame 16 attached with the tractor, or establish a desired relative physical position between the mounting mast 18 portion of the loader 13 relative to the ground supporting the loader.

In an example embodiment, data may be saved into the non-transient memory device 112 during the training wherein the data is representative of the one or more signals 71-74 received from the one or more sensor devices 61-64 wherein the signals 71-74 are in turn representative of the desired position of the mast arms 19 and/or the carrier arms 21 of the front loader 13 relative to the vehicle and/or relative to the ground for pre-positioning the front loader 13 prior to moving the tractor 10 towards the loader 13 for connection therewith.

In particular, data is stored into the non-transient memory device 112 during training that is representative of the signal 71 generated by the tool inclination sensor 61 that is in turn representative of the inclination of the carrier arms 21 relative to the ground supporting the front loader 13.

Further data may be stored into the non-transient memory device 112 during the training that is representative of the link inclination signal 72 from the link inclination sensor 62 wherein the link inclination signal 72 is in turn representative of the sensed pivot angle between the link member 25 and the mast arms 19.

Further data may be stored into the non-transient memory device 112 during the training that is representative of the mounting mast inclination signal 73 from the mounting mast inclination sensor 63 wherein the mounting mast inclination signal 73 is in turn representative of the sensed pivot angle between the mounting mast members 18 and the mast arms 19.

Further data may be stored into the non-transient memory device 112 during the training that is representative of the mast arm inclination signal 74 from the mast arm inclination sensor 64 wherein the mast arm inclination signal 74 is in turn representative of the sensed inclination of the mast arms 19 relative to the ground supporting the front loader 13.

In accordance with an example embodiment, the apparatus 100 includes an attach assist control unit 102 including a processor device 111, a non-transient memory device 112 operatively coupled with the processor device, and attach assist control logic 116 stored in the memory device. In the example embodiment, the processor device is operable to execute the attach assist control logic to generate a pre-position instruction signal for pre-positioning the loader in a predetermined orientation to facilitate the coupling. The processor device is further operable to execute the attach assist control logic to generate a forward movement instruction signal for initiating movement of the associated work vehicle towards the loader. The processor device is still further operable to execute the attach assist control logic to receive a coupled confirmation signal representative of a confirmation of the loader being coupled with the associated work vehicle. The processor device is yet still further operable to execute the attach assist control logic to generate based on receiving the coupled confirmation signal a forward movement pause instruction signal for pausing the movement of the associated work vehicle 1 towards the loader.

The attach assist apparatus of the example embodiment further includes a human readable display unit operably coupled with the attach assist control unit, and an input device operably coupled with the attach assist control unit. The human readable display unit includes a screen operable to display images that are viewable by an operator of the associated work vehicle.

The processor device of the example embodiment is operable to execute the attach assist control logic to generate the pre-position instruction signal by generating a pre-position instruction image and displaying the pre-position instruction image on the screen of the human readable display unit 120, wherein the pre-position instruction image informs an operator of the associated vehicle how to pre-position the loader in the predetermined orientation to facilitate the coupling. The processor device of the example embodiment is operable to execute the attach assist control logic to generate the forward movement instruction signal by generating a forward movement instruction image, and displaying the forward movement instruction image on the screen of the human readable display unit, wherein the forward movement instruction image instructs the operator of the associated work vehicle to initiate the movement of the associated work vehicle towards the loader. The processor device of the example embodiment is operable to execute the attach assist control logic to receive the coupled confirmation signal by receiving a manual coupled confirmation signal by the input device from the operator of the associated vehicle, the coupled confirmation signal confirming by the operator that the loader is coupled with the associated work vehicle. The processor device of the example embodiment is operable to execute the attach assist control logic to generate the forward movement pause instruction signal by generating, responsive to receiving the coupled confirmation signal, a forward movement pause instruction image and displaying the forward movement pause instruction image on the screen of the human readable display unit, wherein the forward movement pause instruction image instructs the operator of the associated work vehicle to pause the movement of the associated work vehicle towards the loader.

The processor device 111 of the attach assist apparatus 100 is operable to execute the attach assist control logic 116 to display an orientation image on the screen 121 of the human readable display unit 120, wherein the orientation image is representative of desired orientations of one or more components of the loader informing the operator of the associated vehicle how to move the one or more components of the loader to predetermined positions for pre-positioning the loader in the predetermined orientation to facilitate the coupling.

The processor device 111 of the attach assist apparatus 100 is operable to execute the attach assist control logic 116 to display the orientation image on the screen 121 of the human readable display unit 120 as one or more of an orientation of a carrier arm 21 of the loader 13, an orientation of a mast arm 19 of the loader 13, and/or an orientation of a mounting mast 18 of the loader 13 that is operably coupleable with a corresponding mounting frame 16 affixed to the associated work vehicle 1.

In the example embodiment herein, the attach assist apparatus 100 further includes a sensor input unit 126 operably coupled with the attach assist control unit 102, and a loader locked sensor 65 operably coupled with the attach assist control unit 102 by the sensor input unit 126, wherein the loader locked sensor 65 is disposed at an interface between a mounting mast 18 of the loader 13 that is operably coupleable with a corresponding mounting frame 16 affixed to the associated work vehicle 1. The processor device 111 of the attach assist apparatus 100 is operable to execute the attach assist control logic 116 to receive the coupled confirmation signal by receiving a loader locked signal 75 from the loader locked sensor 65 as the coupled confirmation signal representative of the confirmation of the loader 13 being coupled with the associated work vehicle 1.

In the example embodiment herein, the processor device 111 of the attach assist apparatus 100 is operable to execute the attach assist control logic 116 to generate a float condition instruction signal to establish a float condition in hydraulic lifting cylinders 24 of the loader 13 to relax a mounting mast 18 of the loader 13 that is operably coupleable with a corresponding mounting frame 16 affixed to the associated work vehicle 1 permitting the mounting mast 18 to move relative to the mounting frame 16 during the coupling.

In the example embodiment herein, the processor device 111 of the attach assist apparatus 100 is operable to execute the attach assist control logic 116 to generate the float condition instruction signal by generating a float condition cycle instruction image on the screen 121 of the human readable display unit 120, wherein the float condition cycle instruction image instructs the operator of the associated work vehicle to intermittently establish, with the loader 13 and the associated work vehicle 1 being in mutual contact and with the associated work vehicle 1 moving towards the loader 13, the float condition between periods of a locked condition of the mounting mast 18 of the loader 13 wherein in the locked condition movement between the mounting mast 18 and the mounting frame 16 is prevented.

In the example embodiment herein, the attach assist apparatus 100 further includes a control signal output unit 127 operably coupled with the attach assist control unit 102, and a valve 52 operably coupled with the attach assist control unit 102 by the control signal output unit 127, wherein the valve 52 is responsive to a control signal 52' generated by the attach assist apparatus 100 to actuate to selectively relieve hydraulic fluid from a chamber of one or more hydraulic lifting cylinders 24 of the loader 13. The processor device 111 is operable to execute the attach assist control logic 116 to generate the float condition instruction signal as the control signal 52' to establish a float condition in hydraulic lifting cylinders 24 of the loader 13 to relax a mounting mast 18 of the loader 13 that is operably coupleable with a corresponding mounting frame 16 affixed to the associated work vehicle 1 permitting the mounting mast 18 to move relative to the mounting frame 16 during the coupling.

In the example embodiment herein, the attach assist apparatus 100 further includes a communication interface 119 operably coupling the attach assist control unit 102 with a controller 135 of the associated work vehicle, and a loader locked sensor 65 operably coupled with the attach assist control unit 102 by the sensor input unit 126, wherein the loader locked sensor 65 is disposed at an interface between a mounting mast 18 of the loader 13 that is operably coupleable with a corresponding mounting frame 16 affixed to the associated work vehicle 1. The processor device 111 is operable to execute the attach assist control logic 116 to generate the pre-position instruction signal by delivering the pre-position instruction signal via the communication interface 119 to the controller 135 the associated work vehicle to automatically pre-position the loader in the predetermined orientation to facilitate the coupling.

In the example embodiment herein, the processor device 111 is operable to execute the attach assist control logic 116 to generate the forward movement instruction signal by delivering the pre-position instruction signal via the communication interface 119 to the controller 135 of the associated work vehicle to automatically initiate the movement of the associated work vehicle 1 towards the loader 13.

In the example embodiment herein, the processor device 111 is operable to execute the attach assist control logic 116 to receive the coupled confirmation signal by automatically receiving the coupled confirmation signal as a loader locked signal 75 from the loader locked sensor 65, the loader locked signal 75 from the loader locked sensor 65 being representative of the confirmation of the loader 13 being coupled with the associated work vehicle 1.

In the example embodiment herein, the processor device 111 is operable to execute the attach assist control logic 116 to generate the forward movement pause instruction signal by delivering, responsive to receiving the coupled confirmation signal, the forward movement pause instruction signal via the communication interface 119 to the controller the associated work vehicle to automatically pause the movement of the associated work vehicle 1 towards the loader 13.

Figure 8:
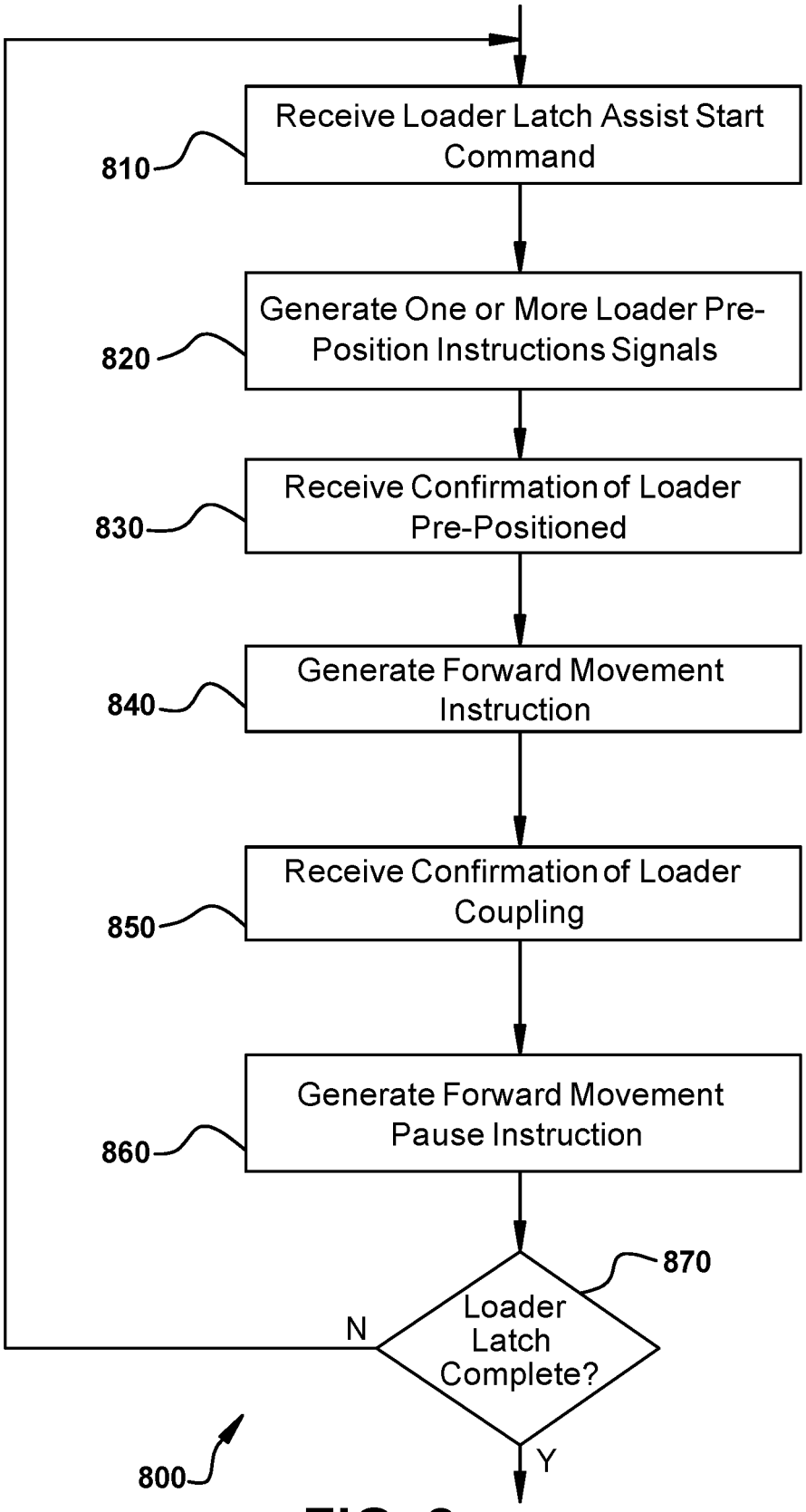
FIG. 8 is a flow diagram illustrating a method of assisting attaching a loader onto a work vehicle in accordance with an example embodiment.

FIG. 8 is a flow diagram illustrating a method 800 of assisting attaching a loader onto a work vehicle in accordance with an example embodiment, and FIGS. 9A-9F illustrations showing instructional images displayed on a human readable display device for assisting coupling a loader with a work vehicle such a tractor. With reference now to those Figures, a loader latch assist start or commence command is received at 810 by the attach assist apparatus 100. The attach assist method 800 is initiated at 810 in response to receiving the loader latch assist start or commence command. It is to be appreciated that the loader 13 and the associated work vehicle 1 are initially mutually spaced apart prior to the attach assist apparatus 100 receiving the start or commence command is received at 810.

A signal may be generated at 820 for instructing the operator to nominally pre-position the tractor relative to the loader in a gross or rough sense, including coupling the portions 50*a*, 50*b* of the multi-coupler 50 with each other. In an example embodiment, the signal may be generated at 820 for instructing the operator to physically nominally pre-position the tractor relative to the loader may be in the form of one or more instruction images 910, 920, 930, and 940 generated for display on the screen 121 of a human readable display unit 120 and such as shown in FIGS. 9A-9D.

The method 800 includes displaying one or more orientation image(s) 910, 920, 930, and 940 on the screen 121 of the human readable display unit 120, wherein the one or more orientation image(s) 910, 920, 930, and 940 are representative of desired orientations of one or more components of the loader informing the operator of the associated vehicle how to move the one or more components of the loader to predetermined positions for pre-positioning the loader in the predetermined orientation to facilitate the coupling. The one or more orientation image(s) 910, 920, 930, and 940 displayed on the screen 121 may include for example information related to one or more of an orientation of a carrier arm 21 of the loader 13, an orientation of a mast arm 19 of the loader 13, and/or an orientation of a mounting mast 18 of the loader 13 that is operably coupleable with a corresponding mounting frame 16 affixed to the associated work vehicle 1.

Figure 9A:
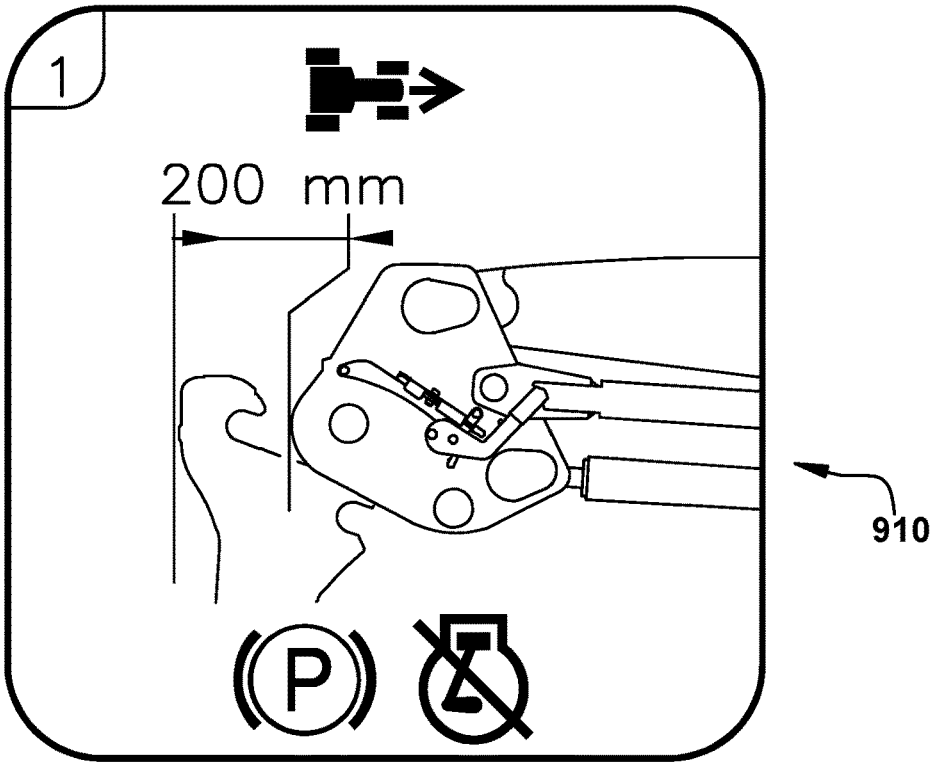
FIGS. 9A-9F illustrations showing instructional images displayed on a human readable display device for assisting coupling a loader with a work vehicle such a tractor.
Figure 9B:
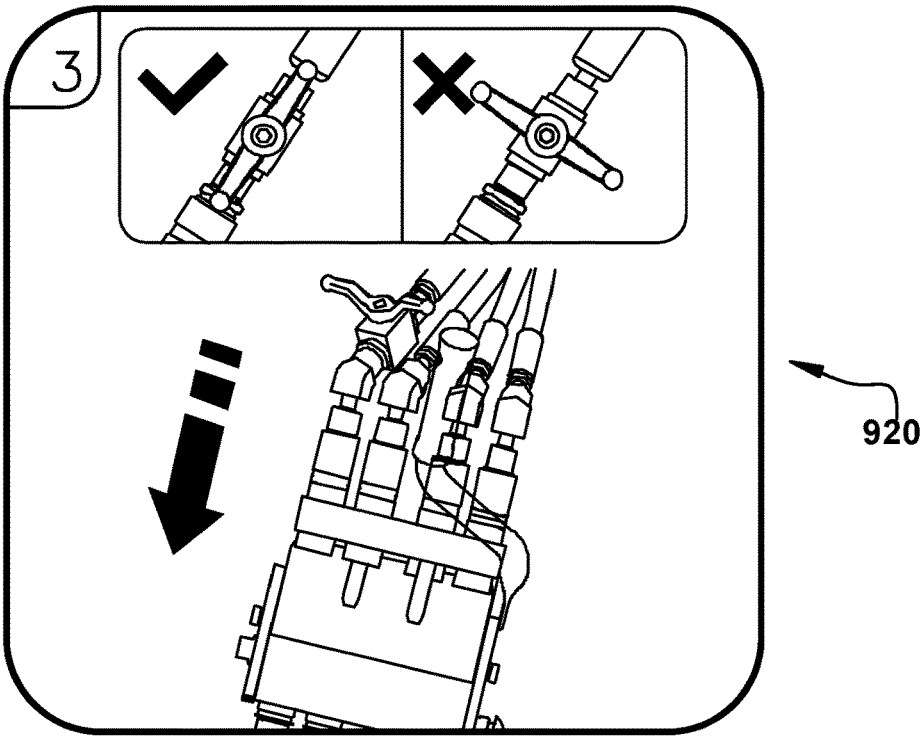

For example, the image 910 shown in FIG. 9A displayed on the screen 121 of the human readable display unit 120 includes information relating to a desired spacing and desired vertical orientation between the mounting mast 18 of the loader 13 and the mounting frame 16 on the tractor 1 for ensuring that the orientation of the mounting mast 18 is suitable for easy connection with the mounting frame 16 on the tractor 1. In this case, one or more electronic service control valves (SCVs) on the loader may be selectively actuated for further pre-positioning the mounting mast portion of the loader in the predetermined orientation to facilitate the coupling. In an example embodiment, a further image 920 (FIG. 9B) provides instructions to the operator on coupling the first and second portions 50*a*, 50*b* of the multi-coupler device 50. It is to be appreciated that the motion of the hydraulic lifting cylinders 24 and/or hydraulic pivoting cylinders 28 may be controlled in accordance with an aspect of the example embodiment by the attach assist apparatus 100 automatically and/or semi-automatically operating the multi-coupler device 50 in accordance with an embodiment while the front loader 13 is detached from the tractor 10 and while the first and second portions 50*a*, 50*b* may be selectively coupled. This may be used to assist the coupling of the loader with the tractor by ensuring that the orientation of the mounting mast 18 is suitable for easy connection with the mounting frame 16 on the tractor 1 using the hydraulics on the loader to move the loader into the desired orientation and height following coupling the first and second portions 50*a*, 50*b* of the multi-coupler device 50.

Figure 9C:
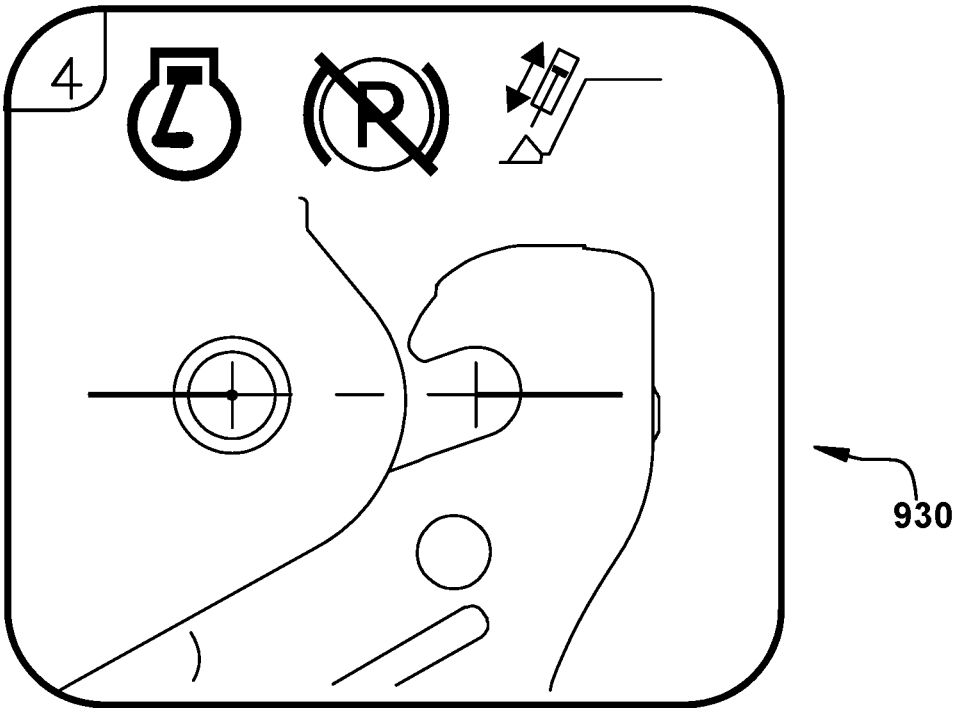

As a further example, the image 930 shown in FIG. 9C displayed on the screen 121 of the human readable display unit 120 includes information relating to a desired vertical orientation between the mounting mast 18 of the loader 13 and the mounting frame 16 on the tractor 1 for ensuring that the orientation of the mounting mast 18 is suitable for easy connection with the mounting frame 16 on the tractor 1. The image instructs the operator that the hydraulic pivoting cylinder 28 may be operated so that the implement or tool 22 carried on the loader and moved thereby in combination with the parking support members 41 of the parking stand unit 40 of the example embodiment can be used to suitably pivot the loader for establishing the desired vertical height of the mounting mast 18 of the loader 13 relative to the mounting frame 16 on the tractor 1.

Figure 9D:
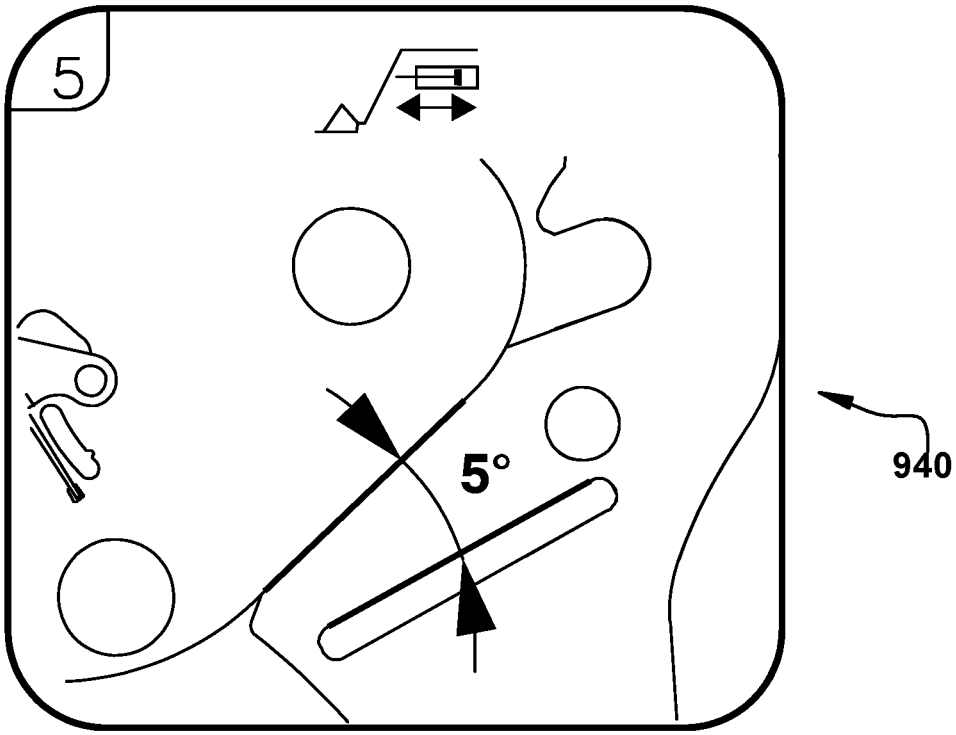
Figure 9E:
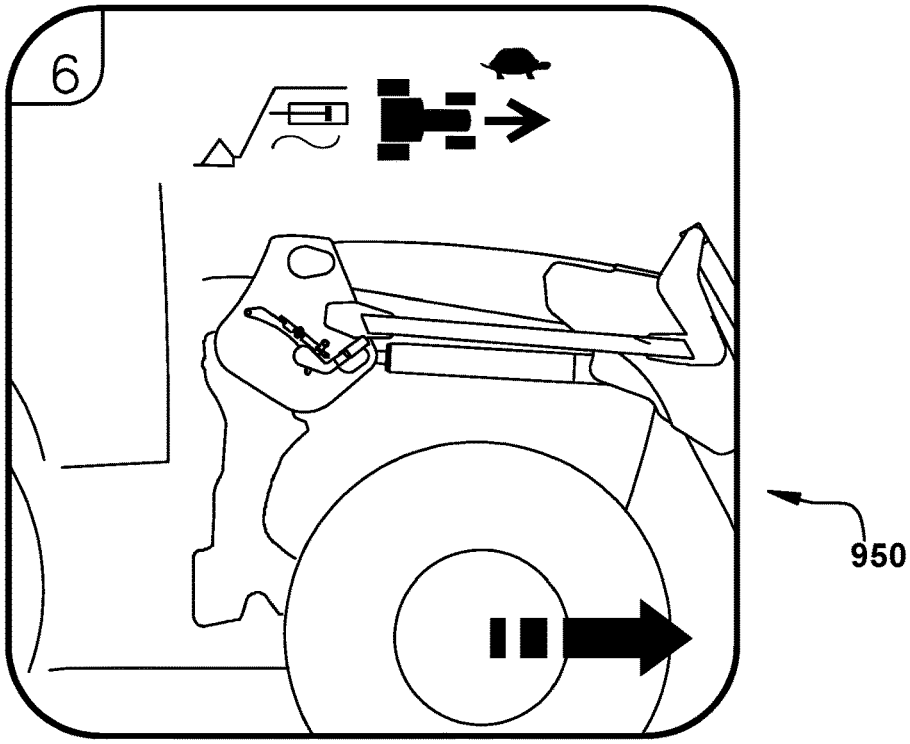
Figure 9F:
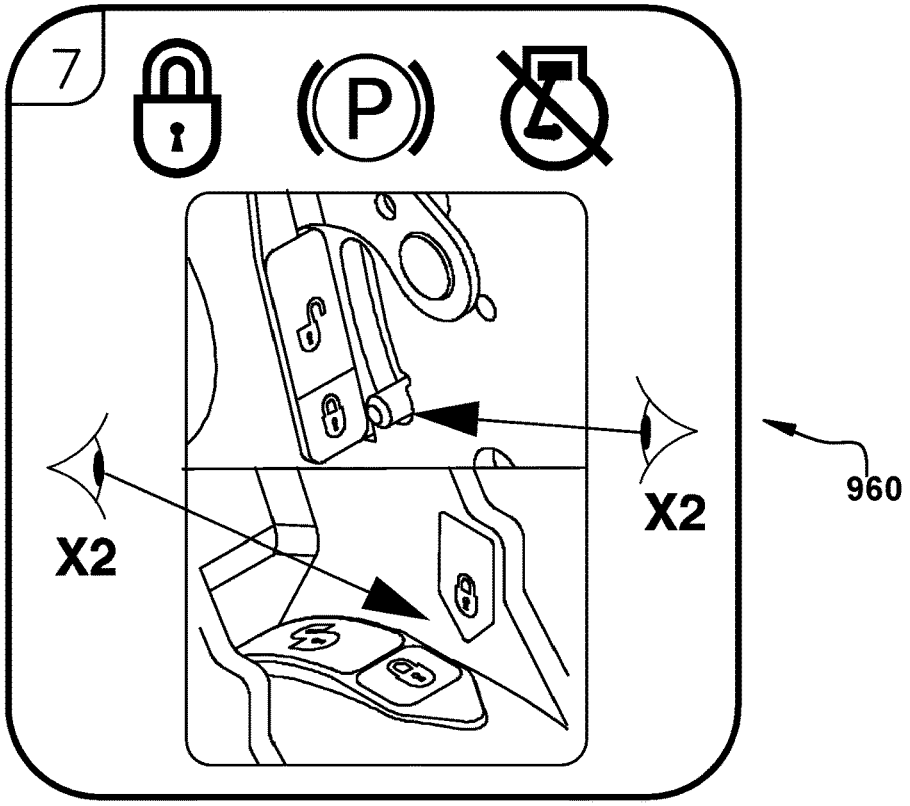

As yet a further example, the image 940 shown in FIG. 9D displayed on the screen 121 of the human readable display unit 120 includes information relating to a desired angular orientation between the mounting mast 18 of the loader 13 and the mounting frame 16 on the tractor 1 for ensuring that the orientation of the mounting mast 18 is suitable for easy connection with the mounting frame 16 on the tractor 1. The image instructs the operator that the pair of hydraulic lifting cylinders 24 may be operated so that the mounting mast 18 of the loader 13 may be moved relative to the mounting frame 16 on the tractor 1 for establishing the desired angular orientation between the mounting mast 18 of the loader 13 and the mounting frame 16 on the tractor 1.

A signal is received at 830 confirming that the tractor is nominally positioned relative to the loader and that the portions 50 *a*, 50 *b* of the multi-coupler 50 are mutually coupled with each other. The signal may be received for example from the operator via the touchscreen 134 by the operator using a pointer or finger touching onto a selected portion of the screen 122 while the mounting mast 18 of the loader 13 and the mounting frame 16 of the tractor 1 are in their respective desired positions.

A forward movement instruction signal is generated at 840 for initiating movement of the associated work vehicle 1 towards the loader 13. In an example, the generating the forward movement instruction signal comprises generating a forward movement instruction image 950 (FIG. 9E) on the screen 121 of a human readable display unit 120, wherein the forward movement instruction image 950 instructs the operator of the associated work vehicle 1 to initiate the movement of the associated work vehicle 1 towards the loader 13.

In addition, at 840, a float condition instruction signal may be generated to establish a float condition in hydraulic lifting cylinders 24 of the loader 13 to relax a mounting mast 18 of the loader 13 that is operably coupleable with a corresponding mounting frame 16 affixed to the associated work vehicle 1 permitting the mounting mast 18 to move relative to the mounting frame 16 during the coupling.

In an example embodiment, the generating the float condition instruction signal at 840 comprises generating a float condition cycle instruction image 950 on the screen 121 of the human readable display unit 120, wherein the float condition cycle instruction image instructs the operator of the associated work vehicle to intermittently establish, with the loader 13 and the associated work vehicle 1 being in mutual contact and with the associated work vehicle 1 moving towards the loader 13, the float condition between periods of a locked condition of the mounting mast 18 of the loader 13 wherein in the locked condition movement between the mounting mast 18 and the mounting frame 16 is prevented.

In a further example embodiment, the generating the float condition instruction signal at 840 comprises delivering the float condition cycle instruction signal via a communication interface 119 to a controller the associated work vehicle to automatically intermittently establish, with the loader 13 and the associated work vehicle 1 being in mutual contact and with the associated work vehicle 1 moving towards the loader 13, the float condition between periods of a locked condition of the mounting mast 18 of the loader 13 wherein in the locked condition movement between the mounting mast 18 and the mounting frame 16 is prevented. The float condition cycle instruction signal is delivered via the communication interface 119 to a controller 135 the associated work vehicle to automatically intermittently establish, with the loader 13 and the associated work vehicle 1 being in mutual contact and with the associated work vehicle 1 moving towards the loader 13, the float condition between periods of a locked condition of the mounting mast 18 of the loader 13 wherein in the locked condition movement between the mounting mast 18 and the mounting frame 16 is prevented.

A further confirmation signal may be received at 850 confirming that the mounting mast 18 is suitably and appropriately coupled with the mounting frame 16 on the tractor. This may be based for example on data stored in the non-transient memory device 112 representative of stored values of the signals 71-74 received by the control unit 102 during training of the attach assist apparatus 100. In an example, the further confirmation signal may comprise the mounting mast inclination signal 73 generated by the mounting mast inclination sensor 63. In an example, the further confirmation signal may comprise the loader locked signal 75 generated by the loader locked sensor 65.

A forward movement pause instruction signal is generated at 860 responsive to the attach assist apparatus 100 receiving the coupled confirmation signal and/or in response to a timeout condition that is in response to the forward movement continuing without receiving the confirmation signal beyond a timeout value stored in the non-transient memory device 112. In an example, the forward movement pause instruction signal comprises one or more forward movement pause instruction images 960 (FIG. 9F) generated on the screen 121 of the human readable display unit 120, wherein the forward movement pause instruction images 960 instruct the operator of the associated work vehicle 1 to pause the movement of the associated work vehicle 1 towards the loader 13.

In a further example, the generating the forward movement pause instruction signal at 860 comprises delivering, responsive to receiving the coupled confirmation signal, the forward movement pause instruction signal via the communication interface 119 to the controller the associated work vehicle to automatically pause the movement of the associated work vehicle 1 towards the loader 13.

Overall and in accordance with an example embodiment, the generating the pre-position instruction signal comprises delivering the pre-position instruction signal via a communication interface 119 to a controller the associated work vehicle to automatically pre-position the loader in the predetermined orientation to facilitate the coupling. In addition, the generating the forward movement instruction signal comprises delivering the pre-position instruction signal via the communication interface 119 to the controller the associated work vehicle to automatically initiate the movement of the associated work vehicle 1 towards the loader 13. In further addition, the receiving the coupled confirmation signal comprises automatically receiving the coupled confirmation signal as a loader locked signal 75 from a loader locked sensor 65 disposed at an interface between a mounting mast 18 of the loader 13 that is operably coupleable with a corresponding mounting frame 16 affixed to the associated work vehicle 1, the loader locked signal 75 from the loader locked sensor 65 being representative of a confirmation of the loader 13 being coupled with the associated work vehicle 1. In still further addition, the generating the forward movement pause instruction signal comprises delivering, responsive to receiving the coupled confirmation signal, the forward movement pause instruction signal via the communication interface 119 to the controller the associated work vehicle to automatically pause the movement of the associated work vehicle 1 towards the loader 13.

A decision is made at 870 on whether the sequence from 840-860 should be repeated such as for example, if the mounting mast 18 does not fully and completely attach with the mounting frame 16.

It is to be understood that other embodiments will be utilized and structural and functional changes will be made without departing from the scope of the present invention. The foregoing descriptions of embodiments of the present invention have been presented for the purposes of illustration and description. It is not intended to be exhaustive or to limit the invention to the precise forms disclosed. Accordingly, many modifications and variations are possible in light of the above teachings. It is therefore intended that the scope of the invention be limited not by this detailed description.

The invention claimed is:

1. An attach assist apparatus for assisting coupling a loader with an associated work vehicle, the apparatus comprising:

an attach assist control unit comprising:

a processor device;

a non-transient memory device operatively coupled with the processor device; and attach assist control logic stored in the memory device;

a human readable display unit operably coupled with the attach assist control unit, the human readable display unit comprising a screen operable to display images that are viewable by an operator of the associated work vehicle; and an input device operably coupled with the attach assist control unit, wherein the processor device is operable to execute the attach assist control logic to:

generate a pre-position instruction image and display the pre-position instruction image on the screen of the human readable display unit, wherein the pre-position instruction image informs an operator of the associated vehicle how to pre-position the loader in a predetermined orientation to facilitate the coupling;

generate a forward movement instruction image and display the forward movement instruction image on the screen of the human readable display unit, wherein the forward movement instruction image instructs the operator of the associated work vehicle to initiate movement of the associated work vehicle towards the loader;

receive a coupled confirmation signal by the input device from the operator of the associated vehicle, the coupled confirmation signal confirming by the operator that the loader is coupled with the associated work vehicle; and generate, responsive to receiving the coupled confirmation signal, a forward movement pause instruction image and display the forward movement pause instruction image on the screen of the human readable display unit, wherein the forward movement pause instruction image instructs the operator of the associated work vehicle to pause the movement of the associated work vehicle towards the loader.

2. The attach assist apparatus according to claim 1, wherein:

the processor device is operable to execute the attach assist control logic to:

display an orientation image on the screen of the human readable display unit, wherein the orientation image is representative of desired orientations of one or more components of the loader informing the operator of the associated vehicle how to move the one or more components of the loader to predetermined positions for pre-positioning the loader in the predetermined orientation to facilitate the coupling.

3. The attach assist apparatus according to claim 2, wherein:

the processor device is operable to execute the attach assist control logic to:

display the orientation image on the screen of the human readable display unit as one or more of:

an orientation of a carrier arm of the loader;

an orientation of a mast arm of the loader; and/or an orientation of a mounting mast of the loader that is operably coupleable with a corresponding mounting frame affixed to the associated work vehicle.

4. The attach assist apparatus according to claim 1, further comprising:

a sensor input unit operably coupled with the attach assist control unit; and a loader locked sensor operably coupled with the attach assist control unit by the sensor input unit, the loader locked sensor being disposed at an interface between a mounting mast of the loader that is operably coupleable with a corresponding mounting frame affixed to the associated work vehicle, wherein the processor device is operable to execute the attach assist control logic to receive the coupled confirmation signal by receiving a loader locked signal from the loader locked sensor as an automated coupled confirmation signal representative of the confirmation of the loader being coupled with the associated work vehicle, wherein the processor device is operable to execute the attach assist control logic to generate the forward movement pause instruction for pausing the movement of the associated work vehicle towards the loader based on receiving the automated coupled confirmation signal.

5. The attach assist apparatus according to claim 1, wherein the processor device is operable to execute the attach assist control logic to:

generate a float condition instruction signal to establish a float condition in hydraulic lifting cylinders of the loader to relax a mounting mast of the loader that is operably coupleable with a corresponding mounting frame affixed to the associated work vehicle permitting the mounting mast to move relative to the mounting frame during the coupling.

6. The attach assist apparatus according to claim 5, wherein:

the processor device is operable to execute the attach assist control logic to generate the float condition instruction signal by:

generating a float condition cycle instruction image as the float condition instruction signal and displaying the float condition cycle instruction image on the screen of the human readable display unit, wherein the float condition cycle instruction image instructs the operator of the associated work vehicle to intermittently establish, with the loader and the associated work vehicle being in mutual contact and with the associated work vehicle moving towards the loader, the float condition between periods of a locked condition of the mounting mast of the loader wherein in the locked condition movement between the mounting mast and the mounting frame is prevented.

7. The attach assist apparatus according to claim 5, further comprising:

a control signal output unit operably coupled with the attach assist control unit; and a valve operably coupled with the attach assist control unit by the control signal output unit, the valve being responsive to a control signal generated by the attach assist apparatus to actuate to selectively relieve hydraulic fluid from a chamber of one or more hydraulic lifting cylinders of the loader, wherein the processor device is operable to execute the attach assist control logic to:

generate the float condition instruction signal as the control signal to establish a float condition in hydraulic lifting cylinders of the loader to relax a mounting mast of the loader that is operably coupleable with a corresponding mounting frame affixed to the associated work vehicle permitting the mounting mast to move relative to the mounting frame during the coupling.

8. An attach assist apparatus for assisting coupling a loader with an associated work vehicle, the apparatus comprising:

an attach assist control unit comprising:

a processor device;

a non-transitory memory device operatively coupled with the processor device; and attach assist control logic stored in the non-transitory memory device;

a communication interface operably coupling the attach assist control unit with a controller of the associated work vehicle; and a loader locked sensor operably coupled with the attach assist control unit, the loader locked sensor being disposed at an interface between a mounting mast of the loader that is operably coupleable with a corresponding mounting frame affixed to the associated work vehicle, wherein the processor device is operable to execute the attach assist control logic to:

generate a pre-position instruction signal for automatically pre-positioning the loader in a predetermined orientation to facilitate the coupling of the loader with the associated work vehicle;

deliver the instruction signal via the communication interface to the controller the associated work vehicle to automatically pre-position the loader in the predetermined orientation to facilitate the coupling of the loader with the associated work vehicle;

generate a forward movement instruction signal for automatically initiating movement of the associated work vehicle towards the loader;

deliver the forward movement instruction signal via the communication interface to the controller of the associated work vehicle to automatically initiate the movement of the associated work vehicle towards the loader;

automatically receive a loader locked signal from the loader locked sensor, the loader locked signal being representative of a confirmation of the loader being coupled with the associated work vehicle; and deliver, responsive to receiving the loader locked signal, a forward movement pause instruction signal via the communication interface to the controller of the associated work vehicle to automatically pause the movement of the associated work vehicle towards the loader.

9. The attach assist apparatus according to claim 8, wherein:

the processor device is operable to execute the attach assist control logic to:

generate a float condition instruction signal to automatically establish a float condition in hydraulic lifting cylinders of the loader to relax a mounting mast of the loader that is operably coupleable with a corresponding mounting frame affixed to the associated work vehicle; and deliver the float condition instruction signal via the communication interface to the controller of the associated work vehicle to automatically establish the float condition in the hydraulic lifting cylinders of the loader to relax the mounting mast of the loader thereby permitting the mounting mast to move relative to the mounting frame during the coupling.

10. The attach assist apparatus according to claim 8, further comprising:

a control signal output unit operably coupled with the attach assist control unit; and a valve operably coupled with the attach assist control unit by the control signal output unit, the valve being responsive to a control signal generated by the attach assist apparatus to establish a float condition by selectively relieving hydraulic fluid from a chamber of one or more hydraulic lifting cylinders of the loader, wherein the processor device is operable to execute the attach assist control logic to:

generate the control signal to establish the float condition in hydraulic lifting cylinders of the loader to relax a mounting mast of the loader that is operably coupleable with a corresponding mounting frame affixed to the associated work vehicle permitting the mounting mast to move relative to the mounting frame during the coupling.

11. A method for assisting coupling a loader with an associated work vehicle, the method comprising:

with the loader and the associated work vehicle mutually spaced apart:

generating a pre-position instruction image on a screen of a human readable display unit, wherein the pre-position instruction image informs an operator of the associated vehicle how to pre-position the loader in a predetermined orientation to facilitate the coupling; and generating a forward movement instruction image on the screen of a human readable display unit, wherein the forward movement instruction image instructs the operator of the associated work vehicle to initiate movement of the associated work vehicle towards the loader; and with the loader and the associated work vehicle being in mutual contact:

receiving a coupled confirmation signal from the operator of the associated vehicle via an input device confirming by the operator that the loader is coupled with the associated work vehicle; and responsive to receiving the coupled confirmation signal, generating a forward movement pause instruction image on the screen of the human readable display unit, wherein the forward movement pause instruction image instructs the operator of the associated work vehicle to pause the movement of the associated work vehicle towards the loader.

12. The method according to claim 11, further comprising:

displaying an orientation image on the screen of the human readable display unit, wherein the orientation image is representative of desired orientations of one or more components of the loader informing the operator of the associated vehicle how to move the one or more components of the loader to predetermined positions for pre-positioning the loader in the predetermined orientation to facilitate the coupling.

13. The method according to claim 12, wherein the displaying the orientation image comprises:

displaying an orientation image on the screen of the human readable display unit of one or more of:

an orientation of a carrier arm of the loader;

an orientation of a mast arm of the loader; and/or an orientation of a mounting mast of the loader that is operably coupleable with a corresponding mounting frame affixed to the associated work vehicle.

14. The method according to claim 11, wherein:

the receiving the coupled confirmation signal comprises:

receiving the coupled confirmation signal as an automated loader locked signal from a loader locked sensor disposed at an interface between a mounting mast of the loader that is operably coupleable with a corresponding mounting frame affixed to the associated work vehicle, the automated loader locked signal from the loader locked sensor being representative of an automated confirmation of the loader being coupled with the associated work vehicle; and the generating the forward movement pause instruction image comprises:

responsive to receiving the automated coupled confirmation signal, generating the forward movement pause instruction image on the screen of the human readable display unit for instructing the operator of the associated work vehicle to pause the movement of the associated work vehicle towards the loader.

15. The method according to claim 11, further comprising:

with the loader and the associated work vehicle being in mutual contact and with the associated work vehicle moving towards the loader:

generating a float condition instruction signal to establish a float condition in hydraulic lifting cylinders of the loader to relax a mounting mast of the loader that is operably coupleable with a corresponding mounting frame affixed to the associated work vehicle permitting the mounting mast to move relative to the mounting frame during the coupling.

16. The method according to claim 15, wherein:

the generating the float condition instruction signal comprises:

generating a float condition cycle instruction image on the screen of the human readable display unit, wherein the float condition cycle instruction image instructs the operator of the associated work vehicle to intermittently establish, with the loader and the associated work vehicle being in mutual contact and with the associated work vehicle moving towards the loader, the float condition between periods of a locked condition of the mounting mast of the loader wherein in the locked condition movement between the mounting mast and the mounting frame is prevented.

17. The method according to claim 15, wherein:

the generating the float condition instruction signal comprises:

delivering the float condition cycle instruction signal via a communication interface to a controller the associated work vehicle to automatically intermittently establish, with the loader and the associated work vehicle being in mutual contact and with the associated work vehicle moving towards the loader, the float condition between periods of a locked condition of the mounting mast of the loader wherein in the locked condition movement between the mounting mast and the mounting frame is prevented.

18. A method for assisting coupling a loader with an associated work vehicle, the method comprising:

with the loader and the associated work vehicle mutually spaced apart:

generating a pre-position instruction signal to pre-position the loader in a predetermined orientation to facilitate the coupling by delivering the pre-position instruction signal via a communication interface to a controller the associated work vehicle to automatically pre-position the loader in the predetermined orientation to facilitate the coupling;

generating a forward movement instruction signal for initiating movement of the associated work vehicle towards the loader by delivering the pre-position instruction signal via the communication interface to the controller the associated work vehicle to automatically initiate the movement of the associated work vehicle towards the loader;

with the loader and the associated work vehicle being in mutual contact:

receiving a coupled confirmation signal representative of a confirmation of the loader being coupled with the associated work vehicle by automatically receiving the coupled confirmation signal as a loader locked signal from a loader locked sensor disposed at an interface between a mounting mast of the loader that is operably coupleable with a corresponding mounting frame affixed to the associated work vehicle, the loader locked signal from the loader locked sensor being representative of the confirmation of the loader being coupled with the associated work vehicle; and responsive to receiving the coupled confirmation signal, delivering forward movement pause instruction signal via the communication interface to the controller the associated work vehicle to automatically pause the movement of the associated work vehicle towards the loader.

19. The method according to claim 18, further comprising:

with the loader and the associated work vehicle being in mutual contact and with the associated work vehicle moving towards the loader:

delivering a float condition instruction signal via the communication interface to the controller the associated work vehicle to automatically establish a float condition in hydraulic lifting cylinders of the loader to relax a mounting mast of the loader that is operably coupleable with a corresponding mounting frame affixed to the associated work vehicle permitting the mounting mast to move relative to the mounting frame during the coupling.

20. The method according to claim 18, further comprising:

with the loader and the associated work vehicle being in mutual contact and with the associated work vehicle moving towards the loader:

delivering a float condition cycle instruction signal via a communication interface to the controller the associated work vehicle to automatically intermittently establish, with the loader and the associated work vehicle being in mutual contact and with the associated work vehicle moving towards the loader, the float condition between periods of a locked condition of the mounting mast of the loader wherein in the locked condition movement between the mounting mast and the mounting frame is prevented.

* * * * *